US010407971B2

(12) United States Patent
Dey et al.

(10) Patent No.: US 10,407,971 B2
(45) Date of Patent: Sep. 10, 2019

(54) GARAGE DOOR SECURITY SYSTEM

(71) Applicant: Google Inc.

(72) Inventors: Sourav Raj Dey, South San Francisco, CA (US); Kevin Charles Peterson, San Francisco, CA (US)

(73) Assignee: GOOGLE LLC, Mountain View, CA (US)

( * ) Notice: Subject to any disclaimer, the term of this patent is extended or adjusted under 35 U.S.C. 154(b) by 297 days.

(21) Appl. No.: 14/993,924

(22) Filed: Jan. 12, 2016

(65) Prior Publication Data

US 2017/0198516 A1 Jul. 13, 2017

(51) Int. Cl.

| | |
|---|---|
| ***E05F 15/77*** | (2015.01) |
| ***G08B 13/08*** | (2006.01) |
| ***E05F 15/668*** | (2015.01) |
| *E05F 15/41* | (2015.01) |

(52) U.S. Cl.

CPC ..... *E05F 15/77* (2015.01); *E05F 15/668* (2015.01); *G08B 13/08* (2013.01); *E05F 15/41* (2015.01); *E05Y 2400/32* (2013.01); *E05Y 2400/36* (2013.01); *E05Y 2400/40* (2013.01); *E05Y 2800/426* (2013.01); *E05Y 2900/106* (2013.01)

(58) Field of Classification Search

None

See application file for complete search history.

(56) References Cited

U.S. PATENT DOCUMENTS

| | | | |
|---|---|---|---|
| 7,119,681 | B2 | 10/2006 | Eskildsen et al. |
| 7,796,052 | B2 | 9/2010 | Katz |
| 8,653,982 | B2 | 2/2014 | Yulkowski et al. |

OTHER PUBLICATIONS

"Smart Garage Door—Project Guidance", at http://beantalk.punchthrough.com/t/smart-garage-door/156, last visited Sep. 21, 2015 (Year: 2015).*

"How can I detect if a garage door is opened or closed?", at http://electronics.stackexchange.com/questions/13769/ how-can-i-detect-if-a-garage-door-is-opened-or-closed, last visited Sep. 21, 2015 (Year: 2015).*

"BlueRadios provides Low Energy Bluetooth 4.0 Smart Ready wireless sensor and single-mode modules for wireless patient medical monitoring", "BlueRadios provides Low Energy Bluetooth 4.0 Smart Ready wireless sensor and single-mode modules for wireless patient medical monitoring," at http://www.blueradios.com/hardware_sensors.htm, last visited Sep. 21, 2015.

(Continued)

*Primary Examiner* — Steven B Gauthier

(74) *Attorney, Agent, or Firm* — Morris & Kamlay LLP

(57) ABSTRACT

A system for analyzing a current movement of a point on a garage door can include a memory, a port, and a processor. The memory can be configured to store a profile. The profile can be produced from one or more previous movements of the point on the garage door. The port can be configured to receive, from a sensor, a signal that corresponds to the current movement of the point on the garage door. The processor can be configured to perform an analysis of the signal with respect to the profile. The processor can be configured to produce a result of the analysis.

22 Claims, 6 Drawing Sheets

(56) References Cited

OTHER PUBLICATIONS

"Econolink Z-Wave Wireless Tilt Sensor—ECO-TILT-US", "Econolink Z-Wave Wireless Tilt Sensor—ECO-TILT-US," at http://www.amazon.com/Econolink-Z-Wave-Wireless-Tilt-Sensor/dp/B00HGVJRX2, last visited Dec. 27, 2015.
"How can I detect if a garage door is opened or closed?", "How can I detect if a garage door is opened or closed?," at http://electronics.stackexchange.com/questions/13769/how-can-i-detect-if-a-garage-door-is-opened-or-closed, last visited Sep. 21, 2015.
"Smart Garage Door—Project Guidance", "Smart Garage Door—Project Guidance," at http://beantalk.punchthrough.com/t/smart-garage-door/156, last visited Sep. 21, 2015.
"Tilt Sensor", "Tilt Sensor," at http://support.vivint.com/product/tilt-sensor, last visited Dec. 27, 2015.

* cited by examiner

100

300

GARAGE DOOR SECURITY SYSTEM

BACKGROUND

In comparison with human proportions, a garage door can have a relatively large size. For example, the garage door can have an area on an order of about 100 square feet. Because of the relatively large size, the garage door can be configured so that, in an open state, the garage door is disposed inside of a garage and is substantially parallel to a ceiling of the garage. In this manner, the garage door can be prevented from being an obstruction in the open state. The garage door can be connected to the garage via a track and roller system. With the track and roller system, at each side of an opening of the garage, a corresponding track can be disposed. At each side of the garage door, rollers can be connected. The rollers connected to a side can be configured to roll along the corresponding track.

The garage door can be divided into sections in which each section is connected to one or more other sections via one or more hinges. A roller can be connected to a side of a section of the garage door near a top of the section. The roller can be connected to the side of the section of the garage door via a pin that is disposed through a center of the roller and is connected to the side of the section of the garage door. The roller can be configured to rotate freely about the pin as the roller rolls along a track. The track can include a vertical piece, a horizontal piece, and an angle piece. The vertical piece can be disposed at a side of the opening of the garage. The horizontal piece can be disposed substantially parallel to the ceiling of the garage so that the horizontal piece and the vertical piece are substantially in a plane. The angle piece can have a first end and a second end. A first end of the angle piece can be connected to the vertical piece. A second end of the angle piece can be connected to the horizontal piece. The angle piece can have a shape that substantially forms an arc. A radius of the arc can have a length of a dimension that allows, when the garage door is being opened, a section of the garage door to rotate from a vertical disposition to a horizontal disposition.

Furthermore, in comparison with other objects routinely lifted by humans, the garage door can have a relatively large weight. For example, the garage door can have a weight on an order of about 100 pounds. Because of the relatively large weight, the garage door can be connected to a counterbalance system configured to produce a force to augment a relatively small force applied to open the garage door. Combined, this relatively small force and the force produced by the counterbalance system can cause the garage door to be opened. The counterbalance system can include, for example, one or more torsion springs, one or more extensions springs, or both.

If the counterbalance system includes torsion springs, then a pair of torsion springs can be disposed around a torsion shaft. The torsion shaft can be disposed inside the garage substantially parallel to a top of the opening of the garage. Each side of the torsion shaft can be connected to a corresponding drum in a manner that allows the torsion shaft and the drums to rotate in unison. Each drum can be connected to a first end of a corresponding torsion cable in a manner that allows the torsion cable to coil around the drum as the drum rotates. A second end of each torsion cable can be connected to a corresponding bottom bracket. Each bottom bracket can be connected to a corresponding bottom corner of the garage door. Additionally, each side of the torsion shaft can be supported by an end bearing. Each end bearing can be disposed at a corresponding side of the opening of the garage. Each end bearing can be connected to a header beam above the opening of the garage or to another load bearing component of the garage. The torsion shaft can also be disposed through a center bracket in a manner that allows the torsion shaft to rotate freely within the center bracket. The center bracket can be connected to the header beam or to another load bearing component of the garage. The center bracket can be disposed substantially at a center of a length of the garage door. Each torsion spring can be connected to a corresponding stationary cone at a first end of the torsion spring and connected to a corresponding winding cone at a second end of the torsion spring. Each stationary cone can be connected to the center bracket. Each winding cone can be connected to the torsion shaft in a manner so that, when the garage door is in a shut state, each torsion spring can be in a compressed state and can be maintained in the compressed state by the weight of the garage door. When a relatively small force is applied to open the garage door, this relatively small force can be augmented by forces produced by of each of the compressed torsion springs. In a process of expanding, the torsion springs can apply a torque to the torsion shaft. The torque applied to the torsion shaft can cause the torsion shaft and the drums to rotate in a manner that causes torsion cables to coil around the drums. As the torsion cables coil around the drums, the torsion cables can apply forces to bottom brackets at the bottom corners of the garage door in a manner that augments the relatively small force applied to open the garage door. Combined, this relatively small force and the force produced by the torsion springs can cause the garage door to be opened.

Additionally or alternatively, if the counterbalance system includes one or more extension springs, then each extension spring of a pair of extension springs can be connected to a load bearing component of the garage, near a corresponding horizontal piece of a corresponding track, at a first end of the extension spring. A second end of each extension spring can be connected to a corresponding cable at a first end of the cable. Each cable can be disposed through a corresponding pulley. Each pulley can be disposed inside the garage near a top corner of the opening of the garage. Each pulley can be connected to the header beam above the opening of the garage or to another load bearing component of the garage. A second end of each cable can be connected to a corresponding bottom bracket. Each bottom bracket can be connected to a corresponding bottom corner of the garage door. When the garage door is in the shut state, each extension spring is in an extended state and can be maintained in the extended state by the weight of the garage door. When a relatively small force is applied to open the garage door, this relatively small force can be augmented by forces produced by of each of the extended extension springs. In a process of contracting, the extension springs can apply forces to the cables. These forces can be redirected by the pulley so that the cables can apply forces to the bottom brackets. The forces applied to the bottom brackets can be applied to the bottom corners of the garage door in a manner that augments the relatively small force applied to open the garage door. Combined, this relatively small force and the force produced by the extension springs can cause the garage door to be opened.

The garage door often can be connected to a garage door opener. The garage door opener can be a device configured to open and to shut the garage door automatically. The garage door opener can be a source of the relatively small force applied to open the garage door. The force produced by the garage door opener can be produced by a motor. The motor can be, for example, an electric motor. The electric motor can be an alternating current motor or a direct current motor. The motor can be controlled by one or more switches, one or more remote controls, or both. A shaft of the motor can be coupled to a drive mechanism in a manner that allows a rotation of the shaft to cause a rotation of the drive mechanism. The drive mechanism can be a chain, a belt, or a screw. The drive mechanism can be disposed substantially parallel to the ceiling of the garage and substantially parallel to a rail. A first end of the rail can be disposed above the opening of the garage substantially at a point that corresponds to the center of the length of the garage door. A second end of the rail can be disposed near to the motor. A trolley can be coupled to the drive mechanism in a manner that allows the rotation of the drive mechanism to cause the trolley to move linearly along the rail. An arm can be connected to the trolley at a first end of the arm. A second end of the arm can be connected to a garage door opener bracket. The garage door opener bracket can be connected to a top section of the garage door substantially at a point that corresponds to the center of the length of the garage door. When the motor of the garage door opener is operating, the rotation of the shaft can cause the rotation of the drive mechanism. The rotation of the drive mechanism can cause the trolley to move linearly along the rail. Movement of the trolley can cause movement of the arm. Movement of the arm can apply a force to the garage door opener bracket. The force applied to the garage door opener bracket can be the relatively small force applied to open the garage door. This relatively small force can be augmented by forces produced by the counterbalance system. Combined, this relatively small force and the force produced by the counterbalance system can cause the garage door to be opened.

BRIEF SUMMARY

According to an embodiment of the disclosed subject matter, a system for analyzing a current movement of a point on a garage door can include a memory, a port, and a processor. The memory can be configured to store a profile. The profile can be produced from one or more previous movements of the point on the garage door. The port can be configured to receive, from a sensor, a signal that corresponds to the current movement of the point on the garage door. The processor can be configured to perform an analysis of the signal with respect to the profile. The processor can be configured to produce a result of the analysis.

According to an embodiment of the disclosed subject matter, a method for analyzing a current movement of a point on a garage door can include receiving, by a processor and from a sensor, a signal that corresponds to the current movement of the point on the garage door. The method can include performing, by the processor, an analysis of the signal with respect to a profile. The profile can be produced from one or more previous movements of the point on the garage door. The method can include producing, by the processor, a result of the analysis.

According to an embodiment of the disclosed subject matter, a non-transitory computer-readable medium storing computer code for controlling a processor to cause the processor to analyze a current movement of a point on a garage door can include instructions to cause the processor to receive, from a sensor, a signal that corresponds to the current movement of the point on the garage door. The computer code can include instructions to perform an analysis of the signal with respect to a profile. The profile produced from one or more previous movements of the point on the garage door. The computer code can include instructions to produce a result of the analysis.

According to an embodiment of the disclosed subject matter, a system for analyzing a current movement of a point on a garage door can include means for receiving, from a sensor, a signal that corresponds to the current movement of the point on the garage door. The system can include means for performing an analysis of the signal with respect to a profile. The profile can be produced from one or more previous movements of the point on the garage door. The system can include means for producing a result of the analysis.

Additional features, advantages, and embodiments of the disclosed subject matter are set forth or apparent from consideration of the following detailed description, drawings, and claims. Moreover, it is to be understood that both the foregoing summary and the following detailed description are illustrative and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate embodiments of the disclosed subject matter and together with the detailed description serve to explain the principles of embodiments of the disclosed subject matter. No attempt is made to show structural details in more detail than may be necessary for a fundamental understanding of the disclosed subject matter and various ways in which it may be practiced.

DETAILED DESCRIPTION

Figure 1:
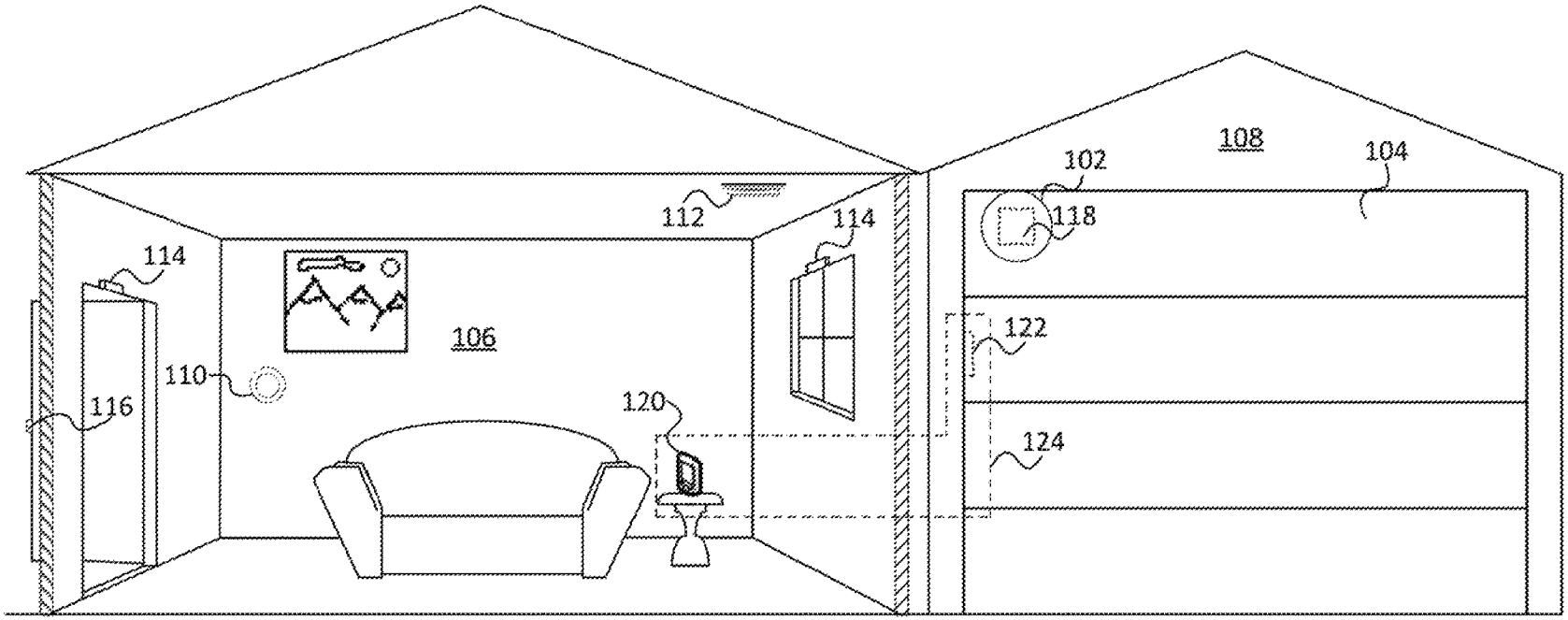
FIG. 1 is a diagram illustrating an example environment in which a current movement of a point on a garage door can be analyzed according to the disclosed subject matter.

A premises security system can perform several functions related to protection of persons and/or property from harm. Such functions can include, for example, an activation of an alarm, an activation of a lock, a transmission of a message to a communications device of a user of the premises security system, a transmission of a message to a communications device of a security agency, the like, or any combination thereof. The property can include land, one or more buildings, one or more items of personal property, or any combination thereof. The property can include a garage. The garage can provide a storage space for personal property. If the garage is attached to a building, then the garage can provide access to one or more other rooms of the building. For at least these reasons, the premises security system can include one or more components configured to provide security for the garage.

Although a principal purpose of a garage door opener can be to open and to shut the garage door, the garage door opener can also be used to provide security for the garage. For example, when a motor of the garage door opener is not operating, a shaft of the motor can be stationary. A drive mechanism of the garage door opener can be coupled to the shaft of the motor in a manner that allows a rotation of the shaft to cause a rotation of the drive mechanism. In response to the shaft being stationary, the drive mechanism can be stationary. A trolley of the garage door opener can be coupled to the drive mechanism in a manner that allows the rotation of the drive mechanism to cause the trolley to move linearly. In response to the drive mechanism being stationary, the trolley can be stationary. An arm of the garage door opener can be connected to the trolley at a first end of the arm. In response to the trolley being stationary, the arm can be stationary. A second end of the arm can be connected to a garage door opener bracket. The garage door opener bracket can be connected to a top section of the garage door. Collectively, having the shaft of the motor, the drive mechanism, the trolley, and the arm in a stationary state can act to provide a force to the garage door to maintain the garage door in a shut state.

The garage door opener can also include an emergency disconnect. The emergency disconnect can be configured to decouple the trolley from the drive mechanism so that the garage door can be opened manually. The emergency disconnect can be intended to be used in an event of a loss of power to the motor of the garage door opener or another emergency. However, it has been demonstrated that a hook inserted into the garage can be used to actuate the emergency disconnect to decouple the trolley from the drive mechanism. For example, the hook can be inserted into a gap formed between a top of an opening of the garage and a top of the garage door. One skilled in performing this feat can complete the act in a frame of time as short as six seconds. Having the trolley decoupled from the drive mechanism in this manner or otherwise can undermine use of the garage door opener to provide security for the garage.

Moreover, an effectiveness of the premises security system can be a function of how the premises security system is operated. Incorrect operation of the premises security system can give rise to false alarms and other problems. Embarrassment and/or frustration caused by such false alarms can discourage a user of the premises security system from maintaining the premises security system in operation. Aspects disclosed herein describe a system and a method for analyzing a current movement of a point on the garage door. A signal that corresponds to the current movement of the point on the garage door can be received. An analysis of the signal with respect to a profile can be performed. The profile can be produced from one or more previous movements of the point on the garage door. A result of the analysis can be produced. A response to the current movement of the point on the garage door can be determined based on the result of the analysis. In this manner, the premises security system can be configured to prevent at least some false alarms. In this manner, the user of the premises security system can be encouraged to maintain the premises security system in operation.

FIG. 1 is a diagram illustrating an example environment in which a current movement of a point 102 on a garage door 104 can be analyzed according to the disclosed subject matter. For example, the environment can include a security system integrated in a smart home environment that can include sensors, interface components, and one or more processing units that process data generated by the sensors and that control the interface components. Data from the sensors can be used to determine the occurrence of a security breach or security related event, such as entry through a window of the premises, lengthy presence of an individual in an unusual location and an unusual time, or tampering with a lock of a door of the premises, etc. Upon the occurrence of such an event, the security system can determine, based on any of various algorithms, that an alarm is warranted and enter into an alarm mode, which can include automatically notifying a third party monitoring service as well as operating components of the system to provide visual and/or audible alerts, such as a siren sound, repeated beeping sound, or flashing lights.

Additionally, the security system can determine where a security breach has occurred and thereafter track the location of the unauthorized party, as well as the locations of authorized parties within and/or around the premises. In addition, in view of the high stress levels that can accompany experiencing an unauthorized intrusion, the security system can announce the location of the security breach and the location of the unauthorized party within the premises. In so doing the authorized occupants are automatically warned of which locations in/around the premises to avoid and the unauthorized party is simultaneously deterred from further advance due to the clear notice to the unauthorized party that he/she is being tracked. Alternatively, the location of the unauthorized party can be announced only to select devices so as to inform an authorized user while leaving the unauthorized party unaware that he/she is being tracked.

The security system can function as a subsystem of a smart facility network system and can incorporate a plurality of electrical and/or mechanical components, including intelligent, sensing, network-connected devices that can communicate with each other and/or can communicate with a central server or a cloud-computing system to provide any of a variety of security (and/or environment) management objectives in a home, office, building or the like. Such objectives, which can include, for example, managing alarms, notifying third parties of alarm situations, managing door locks, monitoring the premises, etc., herein are collectively referred to as "premises management."

A premises management system can further include other subsystems that can communicate with each other to manage different aspects of premises management as well as security. For example, a security subsystem can manage the arming, disarming, and activation of alarms and other security aspects of the premises, and a smart home environment subsystem can handle aspects such as light, temperature, and hazard detection of the premises. However, the premises management system can leverage data obtained in one subsystem to improve the functionality of another subsystem.

The security system can be operable to function in any of various modes or states. For example, security system modes can include "stay", "away" and "home" modes. In a "stay" mode the security system can operate under the assumption that authorized parties are present within the premises but will not be entering/leaving without notifying the system; therefore data from certain interior sensors can be given lower weight in determining whether an unauthorized party is present. In an "away" mode the security system can operate under the assumption that no authorized parties are in the premises; therefore data from all sensors, interior and exterior, can be accorded high weight in determining whether an unauthorized party is present. In a "home" mode the security system can operate under the assumption that authorized parties are within the premises and will be freely entering/leaving the premises without notifying the system; therefore data from certain sensors interior and exterior can be accorded low weight in determining whether an unauthorized party is present. It should be understood that these modes are merely examples and can be modified, removed, or supplemented by other modes.

In addition, the security system can function in any of various alarm states. For example, in a "green" or "low" alarm state the security system can operate under the assumption that all is well and no unauthorized parties have been detected within/around the premises. In a "yellow" or "medium" alarm state the security system can operate under the assumption that an unauthorized party is potentially present in or around the premises. In this state certain sensor data can be analyzed differently or additional confirmations of authorization, such as entering a code, can be required of to avoid escalation to a higher alarm state. In a "red" or "high" alarm state the security system can operate under the assumption that an unauthorized party has been detected on the premises and preventive measures can be taken, such as notifying a third party monitoring service and/or activating an alarm and announcement, as will be described later. It should be understood that greater or fewer gradients of alarm state can be included. Hereinafter, a heightened alarm can refer to an alarm state above the low alarm state.

The security system can be implemented as a stand-alone system or, as mentioned above, as a subsystem of a larger premises management system and can leverage data therefrom. For illustrative purposes and to demonstrate the cross use of data among systems, the security system can be part of a premises management system, such as a smart home network environment.

The individual hardware components of the premises management system that can be used to monitor and affect the premises in order to carry out premises management can be referred to as "premises management devices." The premises management devices described herein can include multiple physical hardware and firmware configurations, along with circuitry hardware (e.g., processors, memory, etc.), firmware, and software programming that are configured to carry out the methods and functions of a premises management system. The premises management devices can be controlled by a "brain" component, which can be implemented in a controller device.

FIG. 1 illustrates an example premises management system 100, installed within premises that include a house 106 and a garage 108. The system 100 can implement subsystems, including the security system, via multiple types of premises management devices, such as one or more intelligent, multi-sensing, network-connected thermostats 110, one or more intelligent, multi-sensing, network-connected hazard detection units 112, one or more intelligent, multi-sensing, network-connected entry detection units 114, one or more network-connected door handles 116, one or more network-connected sensors 118, one or more intelligent, multi-sensing, network-connected controller devices 120 for components associated with the house 106, one or more intelligent, multi-sensing, network-connected controller devices 122 for components associated with the garage 108, or any combination thereof. For example, the one or more sensors 118 can be installed on an interior surface of the garage door 104. For example, the one or more controller devices 122 can be located inside the garage 108 such as on a wall of the garage 108. In an aspect, the function of the one or more controller devices 120 and the function of the one or more controller devices 122 can be incorporated into one or more intelligent, multi-sensing, network-connected controller devices 124, which can be located inside the house 106, inside the garage 108, or both. Data from any of these premise management devices can be used by the security system, as well as for the respective primary functions of the premise management devices.

At a high level, the system 100 can be configured to operate as a learning, evolving ecosystem of interconnected devices. New premises management devices can be added, introducing new functionality, expanding existing functionality, or expanding a spatial range of coverage of the system. Furthermore, existing premises management devices can be replaced or removed without causing a failure of the system 100. Such removal can encompass intentional or unintentional removal of components from the system 100 by an authorized user, as well as removal by malfunction (e.g., loss of power, destruction by intruder, etc.). Due to the dynamic nature of the system, the overall capability, functionality and objectives of the system 100 can change as the constitution and configuration of the system 100 change.

In order to avoid contention and race conditions among the interconnected devices, certain decisions, such as those that affect the premises management system 100 at a system level or that involve data from multiple sources, can be centralized in the aforementioned "brain" component. The brain component can coordinate decision making across the system 100 or across a designated portion thereof. The brain component is a system element at which, for example, sensor/detector states can converge, user interaction can be interpreted, sensor data can be received, and decisions can be made concerning the state, mode, or actions of the system 100. Hereinafter, the system 100 brain component can be referred to as the "primary system processor." The function of primary system processor can be implemented in the controller device 124, for example, hard coded into a single device, or distributed virtually among one or more premises management devices within the system using computational load sharing, time division, shared storage, or other techniques.

However implemented, the primary system processor can be configured to control subsystems and components of the premises management system 100, such as, for example, the disclosed security system and/or a smart home environment system. Furthermore, the primary system processor can be communicatively connected to control, receive data from, or transmit data to premises management devices within the system, as well as receive data from or transmit data to devices/systems external to the system 100, such as third party servers, cloud servers, mobile devices, and the like.

In the embodiments disclosed herein, each of the premises management devices can include one or more sensors. In general, a "sensor" can refer to any device that can obtain information about its local environment and communicate that information in the form of data that can be stored or accessed by other devices and/or systems. Sensor data can form the basis of inferences drawn about the sensor's environment. For example, the primary system processor can use data from a plurality of sensors, e.g., including entry detection unit 114, to determine whether an unauthorized party is attempting enter the house 106 through a window.

A brief description of sensors that may be included in the system 100 follows. Examples provided are not intended to be limiting but are merely provided as illustrative subjects. The system 100 can use data from the types of sensors in order to implement features of a security system. The system 100 can employ data from any type of sensor that provides data from which an inference can be drawn about the environment in or around the house 106.

Generally, sensors can be described by the type of information they collect. For example, sensor types can include motion, smoke, carbon monoxide, proximity, temperature, time, physical orientation, acceleration, location, entry, presence, pressure, light, sound, and the like. A sensor also can be described in terms of the particular physical device that obtains the environmental information. For example, an accelerometer can obtain acceleration information, and thus can be used as a general motion sensor and/or an acceleration sensor. A sensor also can be described in terms of the specific hardware components used to implement the sensor. For example, a temperature sensor can include a thermistor, thermocouple, resistance temperature detector, integrated circuit temperature detector, or combinations thereof.

A sensor further can be described in terms of a function or functions the sensor performs within the system 100. For example, a sensor can be described as a security sensor when it is used to determine security events, such as unauthorized entry.

A sensor can be operated for different functions at different times. For example, system 100 can use data from a motion sensor to determine how to control lighting in the house 106 when an authorized party is present and use the data as a factor to change a security system mode or state on the basis of unexpected movement when no authorized party is present. In another example, the system 100 can use the motion sensor data differently when a security system mode is in an "away" mode versus a "home" state, i.e., certain motion sensor data can be ignored while the system is in a "home" mode and acted upon when the system is in an "away" mode.

In some cases, a sensor can operate as multiple sensor types sequentially or concurrently, such as where a temperature sensor is used to detect a change in temperature, as well as the presence of a person or animal. A sensor also can operate in different modes (e.g., different sensitivity or threshold settings) at the same or different times. For example, a sensor can be configured to operate in one mode during the day and another mode at night. As another example, a sensor can operate in different modes based upon a mode or the disclosed security system, state of system 100, or as otherwise directed by the primary system processor.

Multiple sensors can be arranged in a single physical housing, such as where a single device includes movement, temperature, magnetic, and/or other sensors. Such a housing can also be referred to as a sensor, premises management device, or a sensor device. For clarity, sensors can be described with respect to the particular functions they perform and/or the particular physical hardware used.

Figure 2:
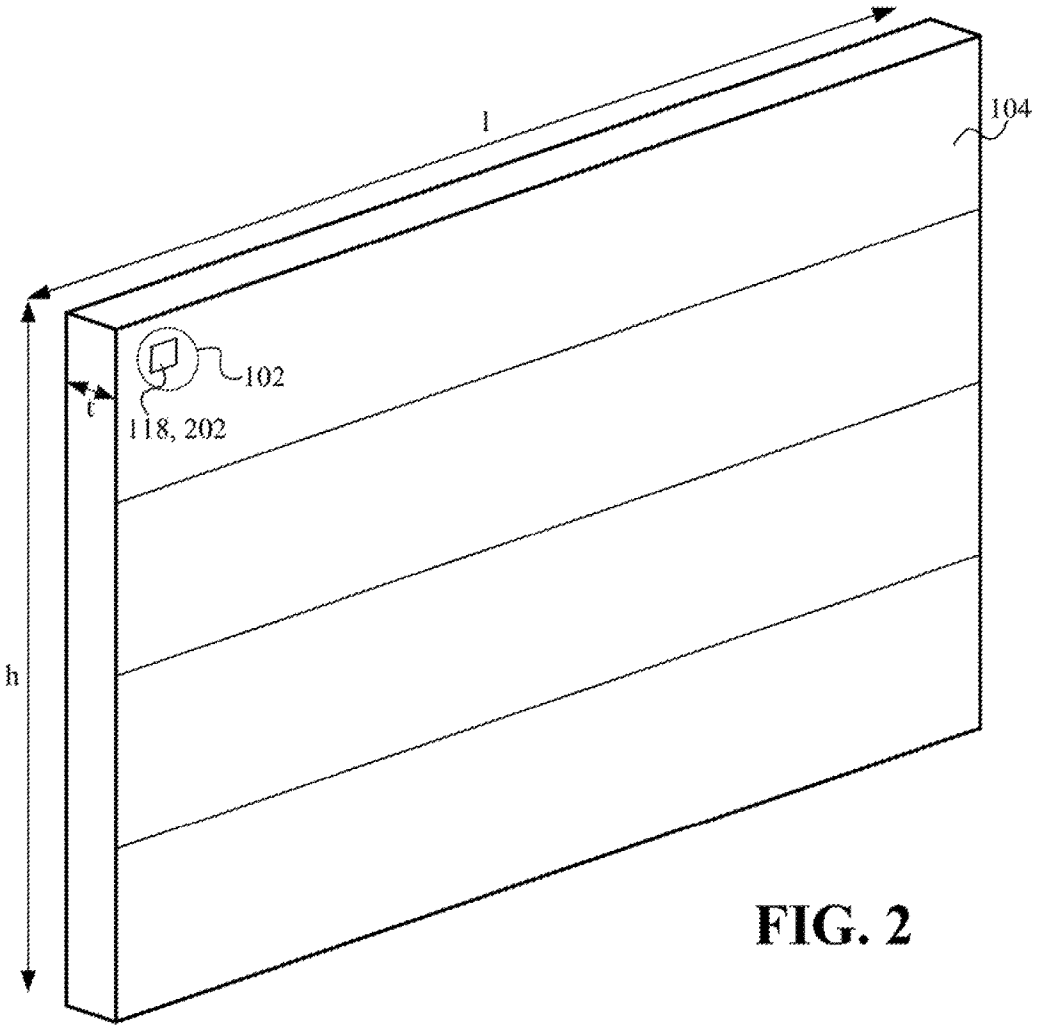
FIG. 2 is a diagram illustrating an example of a garage door.

FIG. 2 is a diagram illustrating an example of the garage door 104. The garage door 104 can be characterized by a length (l), a height (h), and a thickness (t). The sensor 118 can measure a physical characteristic and can produce a signal of a rate of change of the physical characteristic. For example, the sensor 118 can include one or more cameras, one or more infrared sensors, one or more Hall effect sensors, one or more switches, one or more magnetic switches, one or more microswitches, one or more limit switches, one or more tilt switches, one or more microelectromechanical switches, one or more gyroscopes, one or more accelerometers, the like, or any combination thereof.

If the sensor 118 is an accelerometer 202, then the physical characteristic can be forces sensed by the accelerometer 202. The forces sensed by the accelerometer 202 can include a gravitational force produced by a mass of the garage door 104. The accelerometer 202 can be disposed on the garage door 104. Because a top section of the garage door 104 can be an initial section, when the garage door 104 is being opened, to rotate from a vertical disposition to a horizontal disposition, the accelerometer 202 can be disposed on the top section. For example, the accelerometer 202 can be disposed near a top of the top section.

The accelerometer 202 can include a first axis component. The first axis component can be disposed along a height (h) of the garage door 104. In the shut state, the gravitational force sensed by the first axis component can be about 1 g. In the open state, the gravitational force sensed by the first axis component can be about 0 g. In conjunction with the garage door 104 being moved from the shut state to the open state, the gravitational force sensed by the first axis component can transition from about 1 g to about 0 g.

In an aspect, the accelerometer 202 can include a second axis component. The second axis component can be disposed along a thickness (t) of the garage door 104. In the shut state, the gravitational force sensed by the second axis component can be about 0 g. In the open state, the gravitational force sensed by the second axis component can be about 1 g. In conjunction with the garage door 104 being moved from the shut state to the open state, the gravitational force sensed by the first axis component can transition from about 0 g to about 1 g.

In an aspect, the accelerometer 202 can include a third axis component. The third axis component can be disposed along a length (l) of the garage door 104. In the shut state, the gravitational force sensed by the third axis component can be about 0 g. In the open state, the gravitational force sensed by the third axis component can be about 0 g. In conjunction with the garage door 104 being moved from the shut state to the open state, the gravitational force sensed by the third axis component can remain at about 0 g.

Although a transition of the gravitational forces sensed by one or more axes of the accelerometer 202 when the garage door 104 moves from the shut state to the open state generally can be smooth, because the garage door 104 can be divided into sections, the transition can be punctuated at instances at which a section of the garage door 104 completes a movement from a vertical disposition to a horizontal disposition.

Additionally, the forces sensed by the one or more axes of the accelerometer 202 can include forces other than the gravitational forces. For example, rotations of a shaft of a motor of the garage door opener, a drive mechanism of the garage door opener, or both can cause vibrations to occur. Such vibrations can be transferred to a trolley of the garage door opener, an arm of the garage door opener, the garage door 104, one or more rollers of a track and roller system, one or more tracks of the track and roller system, the like, or any combination thereof. Forces associated with such vibrations can be sensed by the one or more axes of the accelerometer 202. In another example, a portion of forces produced by movements of one or more springs of a counterbalance system, one or more cables of the counterbalance system, or both can be sensed by the one or more axes of the accelerometer 202. Such forces can be nonlinear.

Furthermore, a manufacturing defect in the motor, the shaft, the drive mechanism, the trolley, the arm, the garage door 104, the one or more rollers, the one or more tracks, the one or more springs, the one or more cables, the like, or any combination thereof can cause an alteration in the transition of the forces sensed by one or more axes of the accelerometer 202 when the garage door 104 moves from the shut state to the open state. For example, such an alteration can occur at a specific point in time within an interval of time in which in the garage door 104 moves from the shut state to the open state. Forces associated with such an alteration can be sensed by the one or more axes of the accelerometer 202.

Similarly, post-installation damage to the motor, the shaft, the drive mechanism, the trolley, the arm, the garage door 104, the one or more rollers, the one or more tracks, the one or more springs, the one or more cables, the like, or any combination thereof can cause an alteration in the transition of the forces sensed by one or more axes of the accelerometer 202 when the garage door 104 moves from the shut state to the open state. For example, after the track and roller system has been installed, an incident can cause a dent to be produced at a point in one of the tracks. Forces associated with such an alteration can be sensed by the one or more axes of the accelerometer 202.

Figure 3:
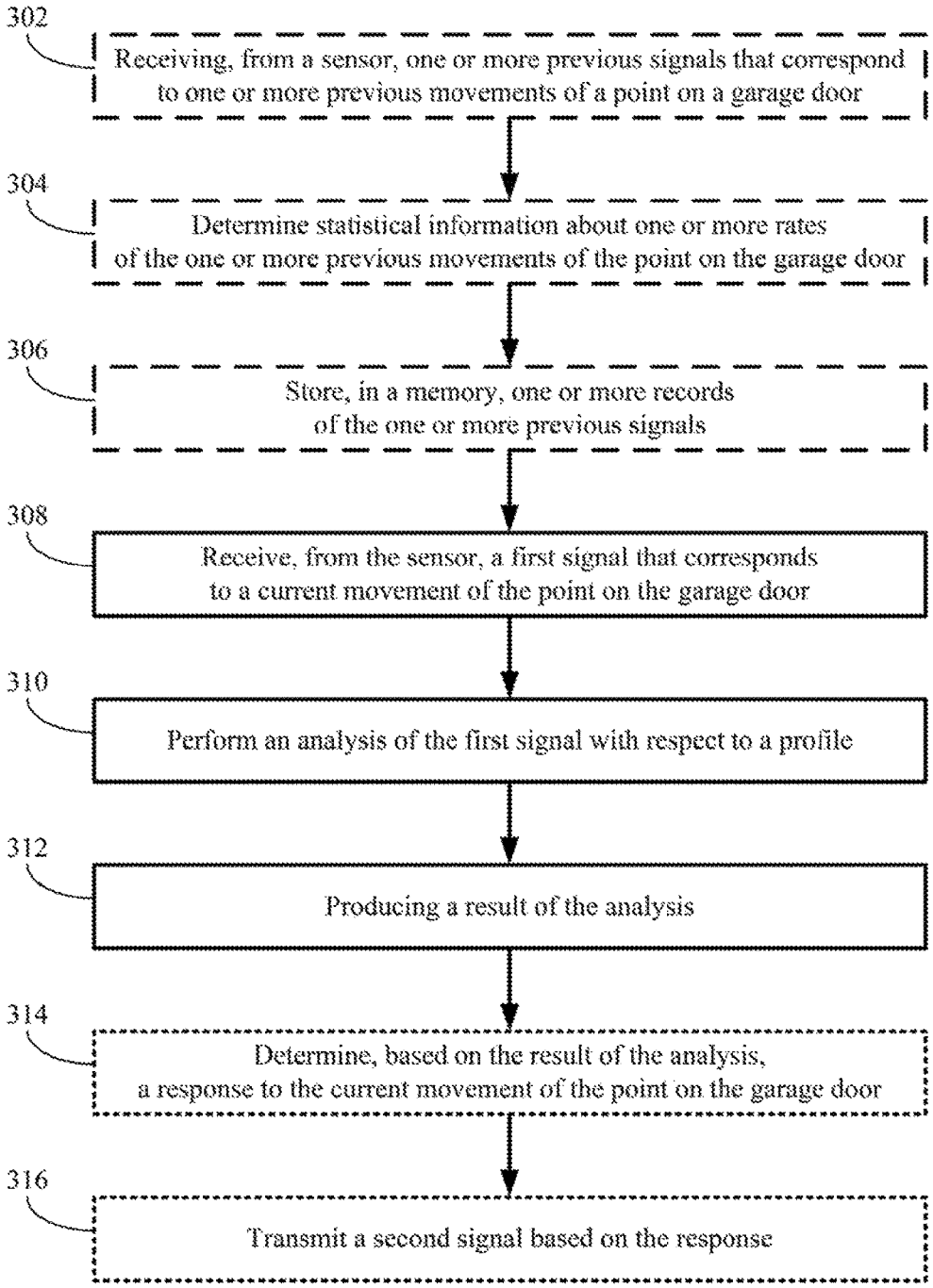
FIG. 3 is a flow diagram illustrating an example of a method for analyzing the current movement of the point on the garage door.

FIG. 3 is a flow diagram illustrating an example of a method 300 for analyzing the current movement of the point 102 on the garage door 104. The method 300 can include one or more operations to produce a profile of one or more previous movements of the point 102 on the garage door 104 and one or more operations to produce a result of an analysis, with respect to the profile, of a signal that corresponds the current movement of the point 102 on the garage door 104. Once the profile has been produced, the profile can be used for repeated performances of the one or more operations to produce the result of the analysis. Accordingly, once the profile has been produced, the method 300 can be performed without the one or more operations to produce the profile. This situation is illustrated in FIG. 3 by the use of dashed lines for the one or more operations to produce the profile. Optionally, the method 300 can include one or more operations to determine a response, based on the result of the analysis, to the current movement of the point 102 on the garage door 104. This situation is illustrated in FIG. 3 by the use of dotted lines for the one or more operations to determine the response.

Regarding the one or more operations to produce the profile, in the method 300, at an operation 302, a first processor can receive, from the sensor 118, one or more previous signals that correspond to one or more previous movements of the point 102 on the garage door 104. For example, the first processor can be the one or more controller devices 122 illustrated in FIG. 1. For example, if the sensor 118 includes a microphone (not illustrated), then the one or more previous signals can correspond to a sound produced by the garage door opener. For example, if the sensor 118 includes an ammeter (not illustrated), then then the one or more previous signals can correspond to a current through a motor of the garage door opener. For example, if the sensor 118 includes a light sensor (not illustrated), then the one or more previous signals can correspond to a change in an illumination produced by a light of the garage door opener.

For example, if the sensor 118 includes the accelerometer 202, then the one or more previous signals can correspond to the change in the gravitational force sensed by the first axis component of the accelerometer 202. The first axis component can be along the height (h) of the garage door 104. In an aspect, the one or more previous signals can further correspond to the change in the gravitational force sensed by the second axis component of the accelerometer 202 and the change in the gravitational force sensed by the third axis component of the accelerometer 202. The second axis component can be along the thickness (t) of the garage door 104. The third axis component can be along the length (l) of the garage door 104. In an aspect, the one or more previous signals can further correspond to one or more other forces sensed by the accelerometer 202. For example, the one or more other forces can be produced by a rotation of a shaft of the motor of the garage door opener, a rotation of a drive mechanism of the garage door opener, a vibration of a trolley of the garage door opener, a vibration of an arm of the garage door opener, a vibration of the garage door 104, a vibration of one or more rollers of a track and roller system, a vibration of one or more tracks of the track and roller system, a movement of one or more springs of a counterbalance system, a movement of one or more cables of the counterbalance system, the like, or any combination thereof. In an aspect, the one or more other forces can further be produced by a manufacturing defect in the motor, the shaft, the drive mechanism, the trolley, the arm, the garage door 104, the one or more rollers, the one or more tracks, the one or more springs, the one or more cables, the like, or any combination thereof. In an aspect, the one or more other forces can further be produced by post-installation damage to the motor, the shaft, the drive mechanism, the trolley, the arm, the garage door 104, the one or more rollers, the one or more tracks, the one or more springs, the one or more cables, the like, or any combination thereof.

At an operation 304, the first processor can determine statistical information about one or more rates of the one or more previous movements of the point 102 on the garage door 104. The profile can include the statistical information. In this manner, the profile can be customized for a specific garage door 104. In an aspect, the profile can be produced only from those one or more previous movements of the point 102 on the garage door 104 that correspond to a movement of the garage door 104 from a fully shut state to a fully open state. If the sensor 118 includes the accelerometer 202, then the statistical information can include, for example, a degree of constancy of a rate of movement of the first axis component, a degree of constancy of a rate of movement of the second axis component, a minimum rate of movement of the first axis component, a minimum rate of movement of the second axis component, a maximum rate of movement of the first axis component, a maximum rate of movement of the second axis component, a degree of consistency of a difference between forces sensed by the first axis component and forces sensed by the second axis component, a maximum rate of movement of the third axis component, an average of any of the foregoing, a median of the any of the foregoing, a standard deviation of the any of the foregoing, a histogram of the any of the foregoing, or any combination thereof.

Optionally, at an operation 306, one or more records of the one or more previous signals can be stored in a memory. The profile can further include the one or more records.

In an aspect, the operation 302 and the operation 304, and optionally the operation 306, can be performed automatically in response to the sensor 118 being initially operated as a component of the premises security system 100. In this aspect, once production of the profile has been commenced, the profile can be produced in a manner that does not require the user of the premises security system 100 or another individual to provide information for the production of the profile. Alternatively, production of the profile can include information provided by the user of the premises security system 100 or another individual. For example, such information can include an initiation of a training mode. In response to the initiation of the training mode, the garage door 104 can be caused to cycle a number of times between the shut state and the open state to produce the profile. The number of times can be determined by the premises security system 100 or can be a predetermined number of times.

In an aspect, the operation 302 and the operation 304, and optionally the operation 306, can be performed for a duration of time in response to the sensor 118 being initially operated as a component of the premises security system 100. Additionally or alternatively, the duration of time can commence at a time selected by the user of the premises security system 100. For example, an original profile can be produced when the sensor 118 has initially been operated as a component of the premises security system 100, but an updated profile can be produced at the time selected by the user. The updated profile can be produced, for example, in response to damage incurred in a motor of a garage door opener, a shaft of the motor, a drive mechanism of the garage door opener, a trolley of the garage door opener, an arm of the garage door opener, the garage door 104, one or more rollers of a track and roller system, one or more tracks of the track and roller system, one or more springs of a counterbalance system, one or more cables of the counterbalance system, the like, or any combination thereof that causes an alteration in the physical characteristic measured by the sensor 118 when the garage door 104 moves from the shut state to the open state. In this manner, the updated profile can be used to prevent at least some false alarms.

In an aspect, the duration of time during which the profile is produced can be completed at a specific time after the duration of time has commenced. The specific time can be a week, a month, or the like. The specific time can be determined automatically or the specific time can be selected by the user of the premises security system 100. Alternatively, the duration of time can be endless. For example, with each occurrence of the garage door 104 being moved from the shut state to the open state, a recording of the rate of change of the physical characteristic measured by the sensor 118 can be made. This recording can be analyzed with respect to the profile. If information about an aspect of a current occurrence is within a threshold of statistical information about a corresponding aspect included in the profile, then the profile can be updated to include the information about the current occurrence. In an aspect, the profile can be updated in a manner in which, in response to including the information about the current occurrence in the profile, information about an earlier occurrence can be removed from the profile.

For example, if the rate of movement of the first axis component for a current occurrence is within the standard deviation of the rate of movement of the first axis component included in the profile, then the profile can be updated to include the information about the current occurrence. In this manner, for example, the profile can be updated gradually to account for changes due to aging of the motor, the shaft, the drive mechanism, the trolley, the arm, the garage door 104, the one or more rollers, the one or more tracks, the one or more springs, the one or more cables, the like, or any combination thereof that causes a gradual alteration in the transition of the forces sensed by one or more axes of the accelerometer 202 when the garage door 104 changes from the shut state to the open state. For example, the forces produced by the springs of the counterbalance system can become smaller in response to aging of the springs. Because a portion of these forces can be sensed by the one or more axes of the accelerometer 202, this portion of these forces can also become smaller in response to the aging of the springs. In this manner, the profile can be updated to prevent at least some false alarms.

In an aspect, the profile can further include information about dates and times associated with the occurrences of the garage door 104 being moved from the shut state to the open state that are included in the profile. A pattern can be derived from this information. For example, the pattern can indicate that during the weekdays, the garage door 104 is usually opened and shut between 8:00 am and 8:15 am, and is usually opened and shut between 5:45 pm and 6:00 pm. For example, the pattern can indicate that during the winter the garage door 104 is usually shut around 5:30 pm on the weekends, and that during the summer the garage door 104 is usually shut around 8:30 pm on the weekends.

Regarding the one or more operations to produce the result of the analysis, at an operation 308, the first processor can receive, from the sensor 118, a first signal that corresponds to the current movement of the point 102 on the garage door 104. If the sensor 118 includes the accelerometer 202, then the first signal can correspond to the change in the gravitational force applied to the first axis component of the accelerometer 202. The first axis component can be along the height (h) of the garage door 104. In an aspect, the first signal can further correspond to the change in the gravitational force sensed by the second axis component of the accelerometer 202 and the change in the gravitational force sensed by the third axis component of the accelerometer 202. The second axis component can be along the thickness (t) of the garage door 104. The third axis component can be along the length (l) of the garage door 104. In an aspect, the first signal can further correspond to one or more other forces sensed by the accelerometer 202. For example, the one or more other forces can be produced by a rotation of a shaft of a motor of the garage door opener, a rotation of a drive mechanism of the garage door opener, a vibration of a trolley of the garage door opener, a vibration of an arm of the garage door opener, a vibration of the garage door 104, a vibration of one or more rollers of a track and roller system, a vibration of one or more tracks of the track and roller system, a movement of one or more springs of a counterbalance system, a movement of one or more cables of the counterbalance system, the like, or any combination thereof. In an aspect, the one or more other forces can further be produced by a manufacturing defect in the motor, the shaft, the drive mechanism, the trolley, the arm, the garage door 104, the one or more rollers, the one or more tracks, the one or more springs, the one or more cables, the like, or any combination thereof. In an aspect, the one or more other forces can further be produced by post-installation damage to the motor, the shaft, the drive mechanism, the trolley, the arm, the garage door 104, the one or more rollers, the one or more tracks, the one or more springs, the one or more cables, the like, or any combination thereof.

At an operation 310, the first processor can perform the analysis of the first signal with respect to the profile. If the profile includes the statistical information about the one or more rates of the one or more previous movements of the point 102 on the garage door 104, then the analysis can be performed with respect to the statistical information. For example, if the sensor 118 includes the accelerometer 202, then the analysis can be performed with respect to the statistical information that can include a degree of constancy of a rate of movement of the first axis component, a degree of constancy of a rate of movement of the second axis component, a minimum rate of movement of the first axis component, a minimum rate of movement of the second axis component, a maximum rate of movement of the first axis component, a maximum rate of movement of the second axis component, a degree of consistency of a difference between forces sensed by the first axis component and forces sensed by the second axis component, a maximum rate of movement of the third axis component, an average of any of the foregoing, a median of the any of the foregoing, a standard deviation of the any of the foregoing, a histogram of the any of the foregoing, or any combination thereof.

For example, the degree of constancy of the rate of movement of the first axis component (along the height (h) of the garage door 104) when the garage door 104 is moved, by the garage door opener, from the shut state to the open state can be greater than the degree of constancy of the rate of movement of the first axis component when the garage door 104 is moved manually from the shut state to the open state. Likewise, the degree of constancy of the rate of movement of the second axis component (along thickness (t) of the garage door 104) when the garage door 104 is moved, by the garage door opener, from the shut state to the open state can be greater than the degree of constancy of the rate of movement of the second axis component when the garage door 104 is moved manually from the shut state to the open state.

In another example, having the rate of movement of the first axis component be less than the minimum rate of movement of the first axis component included in the statistical information, having the rate of movement of the second axis component be less than the minimum rate of movement of the second axis component included in the statistical information, or both can be an indication that the garage door 104 is being moved manually or abnormally. Likewise, having the rate of movement of the first axis component be greater than the maximum rate of movement of the first axis component included in the statistical information, having the rate of movement of the second axis component be greater than the maximum rate of movement of the second axis component included in the statistical information, or both can be an indication that the garage door 104 is being moved manually or abnormally.

In another example, the degree of consistency of the difference between forces sensed by the first axis component and forces sensed by the second axis component can be greater when the garage door 104 is being moved within the constraints of the track and roller system than the degree of consistency of the difference between forces sensed by the first axis component and forces sensed by the second axis component when the garage door 104 is being moved outside of the constraints of the track and roller system. Likewise, having the rate of movement of the third axis component (along the length (l) of the garage door 104) be greater than the maximum rate of movement of the third axis component included in the statistical information can be an indication that the garage door 104 is being moved outside of the constraints of the track and roller system. Having the garage door 104 being moved outside of the constraints of the track and roller system can be an indication that the garage door 104 is being moved by a potential intruder.

At an operation 312, the first processor can produce the result of the analysis. If the profile includes the statistical information about the one or more rates of the one or more previous movements of the point 102 on the garage door 104, then the result can be produced with respect to the statistical information. In an aspect, the result can include a first difference between a first statistic of a rate of the current movement of the point 102 on the garage door 104 and the first statistic of the one or more rates of the one or more previous movements of the point 102 on the garage door 104. For example, the first difference can be between a measure of a degree of constancy of a rate of movement of the first axis component of the accelerometer 202 during the current movement of the point 102 on the garage door 104 and a measure of a degree of constancy of a rate of movement of the first axis component of the accelerometer 202 during the one or more previous movements of the point 102 on the garage door 104.

In an aspect, the result can include a sum of the first difference added to a second difference. The second difference can be between a second statistic of the rate of the current movement of the point 102 on the garage door 104 and the second statistic of the one or more rates of the one or more previous movements of the point 102 on the garage door 104. For example, the second difference can be between a measure of a minimum rate of movement of the second axis component of the accelerometer 202 during the current movement of the position of the point 102 on the garage door 104 and a measure of a minimum rate of movement of the second axis component of the accelerometer 202 during the one or more previous movements of the position of the point 102 on the garage door 104.

In an aspect, the result can include a sum of a first product added to a second product. The first product can be the first difference multiplied by a first weight. The second product can be the second difference multiplied by a second weight. A weight can be any real number. The real number can be a rational number or an irrational number, a positive number or a negative number, a whole number or a fraction, or any combination thereof. For example, the first weight and the second weight can be selected so that an effect of the first difference on the result can be greater than an effect of the second difference on the result.

Additionally, the result can include a mathematical equation that includes one or more other differences, one or more other weights, or both. In general, if the result is based on a difference between a statistic of the rate of the current movement of the point 102 on the garage door 104 and the statistic of the one or more rates of the one or more previous movements of the point 102 on the garage door 104, then a large value of the result can be indicative of a large difference, which can be indicative that the movement of the garage door 104 is abnormal.

Regarding the one or more operations to determine the response, optionally, at an operation 314, a second processor can determine, based on the result of the analysis, the response to the current movement of the point 102 on the garage door 104. For example, the second processor can be the one or more controller devices 120 illustrated in FIG. 1. In an aspect, the second processor can be the first processor. For example, the first processor and the second processor can be the one or more controller devices 124 illustrated in FIG. 1.

For example, the response can include an activation of an alarm, an activation of a lock, a transmission of a message to a communications device of the user of the premises security system 100, a transmission of a message to a communications device of a security agency, the like, or any combination thereof. The alarm can be an audible alarm, a visual alarm, a tactile alarm, or any combination thereof. The message can be transmitted via a circuit-switched network, a packet-switched network, or both. The communications device can be a telephone, a smartphone, a cellular phone, a personal digital assistant, a wireless communication device, a handheld device, a desktop computer, a laptop computer, a netbook, a tablet computer, or the like. The security agency can be a private security agency, a police force, or both.

In an aspect, the response can include more than one response. If the result is based on a difference between a statistic of the rate of the current movement of the point 102 on the garage door 104 and the statistic of the one or more rates of the one or more previous movements of the point 102 on the garage door 104, then a large value of the result can be indicative of a large difference, which can be indicative that the movement of the garage door 104 is abnormal. The more than one response can be a function of a difference between the result (the result itself can be based on a difference) and a threshold. For example, if the difference between the result and the threshold is a negative number (i.e., the result is within the threshold), then the second processor can select a first response. For example, the first response can be the transmission of the message to the communications device of the user of the premises security system 100. If the difference between the result and the threshold is a positive number (i.e., the result is beyond the threshold), then the second processor can select a second response. For example, the second response can be the activation of the alarm, the activation of the lock, the transmission of the message to the communications device of the user of the premises security system 100, the transmission of the message to the communications device of the security agency, the like, or any combination thereof. Additionally, the more than one response can include more than two responses, the threshold can include more than one threshold, or both. In this manner, the threshold(s) can be used to prevent at least some false alarms.

Optionally, at an operation 316, the second processor can transmit a second signal based on the response. For example, the second signal can be configured to cause the activation of the alarm, the activation of the lock, the transmission of the message to the communications device of the user of the premises security system 100, the transmission of the message to the communications device of the security agency, the like, or any combination thereof. In an aspect, a transmission of the second signal can be delayed, based on the result being within a threshold, for a duration of time. For example, if a recent incident caused a dent to be produced at a point in one of the tracks of the track and roller system, then forces associated with such an alteration can be sensed by the one or more axes of the accelerometer 202 when the user of the premises security system 100 uses the garage door opener to open the garage door 104. If the result of the analysis is based on a difference between a statistic of the rate of the current movement of the point 102 on the garage door 104 and the statistic of the one or more rates of the one or more previous movements of the point 102 on the garage door 104, then such an alteration can produce an abnormal result. The response based on the abnormal result can be a transmission of a message to a communications device of the user of the premises security system 100 and an activation of an alarm. However, if the abnormal response is within the threshold, then the transmission of the second signal to cause the activation of the alarm can be delayed for a duration of time. For example, the duration of time can be an amount of time to allow the user of the premises security system 100 to respond to the message received at the communications device by causing the premises security system 100 to prevent the activation of the alarm. For example, the duration of time can be about three minutes. In this manner, the delay for the duration of time can be used to prevent at least some false alarms.

Figure 4:
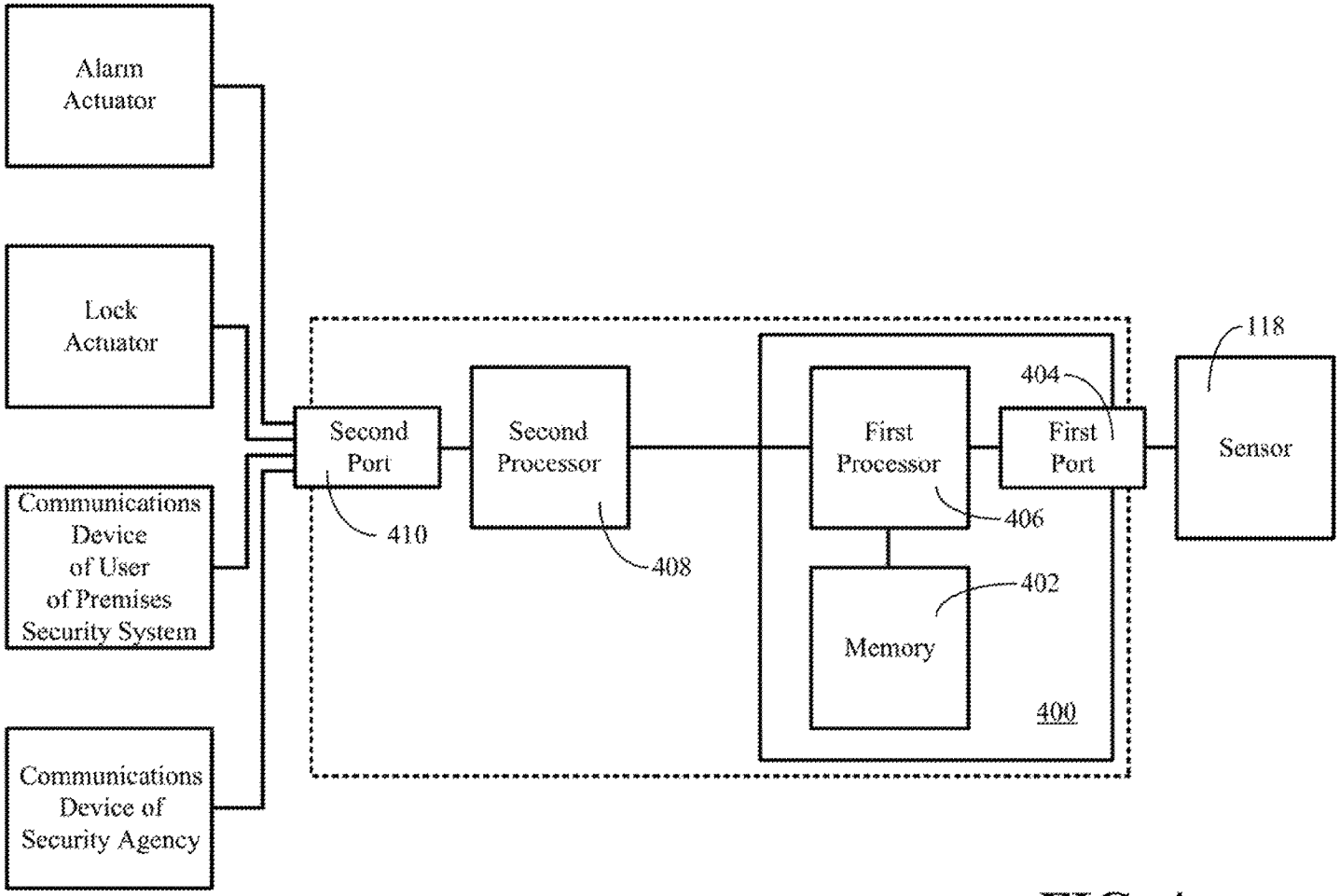
FIG. 4 is a block diagram illustrating an example of a system for analyzing the current movement of the point on the garage door.

FIG. 4 is a block diagram illustrating an example of a system 400 for analyzing the current movement of the point 102 on the garage door 104. The system 400 can include a memory 402, a first port 404, and a first processor 406. For example, the first processor 406 can be the one or more controller devices 122 illustrated in FIG. 1.

The memory 402 can be configured to store a profile. The profile can be produced from one or more previous movements of the point 102 on the garage door 104.

The system 400 can be used for production of the profile. Regarding production of the profile, the first port 404 can be configured to receive, from the sensor 118, one or more previous signals that correspond to the one or more previous movements of the point 102 on the garage door 104. For example, if the sensor 118 includes a microphone (not illustrated), then the one or more previous signals can correspond to a sound produced by the garage door opener. For example, if the sensor 118 includes an ammeter (not illustrated), then then the one or more previous signals can correspond to a current through a motor of the garage door opener. For example, if the sensor 118 includes a light sensor (not illustrated), then the one or more previous signals can correspond to a change in an illumination produced by a light of the garage door opener.

For example, if the sensor 118 includes the accelerometer 202, then the one or more previous signals can correspond to the change in the gravitational force sensed by the first axis component of the accelerometer 202. The first axis component can be along the height (h) of the garage door 104. In an aspect, the one or more previous signals can further correspond to the change in the gravitational force sensed by the second axis component of the accelerometer 202 and the change in the gravitational force sensed by the third axis component of the accelerometer 202. The second axis component can be along the thickness (t) of the garage door 104. The third axis component can be along the length (l) of the garage door 104. In an aspect, the one or more previous signals can further correspond to one or more other forces sensed by the accelerometer 202. For example, the one or more other forces can be produced by a rotation of a shaft of the motor of the garage door opener, a rotation of a drive mechanism of the garage door opener, a vibration of a trolley of the garage door opener, a vibration of an arm of the garage door opener, a vibration of the garage door 104, a vibration of one or more rollers of a track and roller system, a vibration of one or more tracks of the track and roller system, a movement of one or more springs of a counterbalance system, a movement of one or more cables of the counterbalance system, the like, or any combination thereof. In an aspect, the one or more other forces can further be produced by a manufacturing defect in the motor, the shaft, the drive mechanism, the trolley, the arm, the garage door 104, the one or more rollers, the one or more tracks, the one or more springs, the one or more cables, the like, or any combination thereof. In an aspect, the one or more other forces can further be produced by post-installation damage to the motor, the shaft, the drive mechanism, the trolley, the arm, the garage door 104, the one or more rollers, the one or more tracks, the one or more springs, the one or more cables, the like, or any combination thereof.

The first processor 406 can be configured to determine statistical information about one or more rates of the one or more previous movements of the point 102 on the garage door 104. The profile can include the statistical information. In this manner, the profile can be customized for a specific garage door 104. In an aspect, the profile can be produced only from those one or more previous movements of the point 102 on the garage door 104 that correspond to a movement of the garage door 104 from a fully shut state to a fully open state. If the sensor 118 includes the accelerometer 202, then the statistical information can include, for example, a degree of constancy of a rate of movement of the first axis component, a degree of constancy of a rate of movement of the second axis component, a minimum rate of movement of the first axis component, a minimum rate of movement of the second axis component, a maximum rate of movement of the first axis component, a maximum rate of movement of the second axis component, a degree of consistency of a difference between forces sensed by the first axis component and forces sensed by the second axis component, a maximum rate of movement of the third axis component, an average of any of the foregoing, a median of the any of the foregoing, a standard deviation of the any of the foregoing, a histogram of the any of the foregoing, or any combination thereof.

Optionally, the memory 402 can be configured to store one or more records of the one or more previous signals. The profile can further include the one or more records.

In an aspect, the first port 404 can be configured to receive the one or more previous signals, the first processor 406 can be configured to determine the statistical information, and optionally the memory can be configured to store the one or more records, automatically in response to the sensor 118 being initially operated as a component of a premises security system 100. In this aspect, once production of the profile has been commenced, the profile can be produced in a manner that does not require the user of the premises security system 100 or another individual to provide information for the production of the profile. Alternatively, production of the profile can include information provided by the user of the premises security system 100 or another individual. For example, such information can include an initiation of a training mode. In response to the initiation of the training mode, the garage door 104 can be caused to cycle a number of times between the shut state and the open state to produce the profile. The number of times can be determined by the premises security system 100 or can be a predetermined number of times.

In an aspect, the first port 404 can be configured to receive the one or more previous signals, the first processor 406 can be configured to determine the statistical information, and optionally the memory can be configured to store the one or more records, for a duration of time in response to the sensor 118 being initially operated as a component of the premises security system 100. Additionally or alternatively, the duration of time can commence at a time selected by the user of the premises security system 100. For example, an original profile can be produced when the sensor 118 has initially been operated as a component of the premises security system 100, but an updated profile can be produced at the time selected by the user. The updated profile can be produced, for example, in response to damage incurred in a motor of a garage door opener, a shaft of the motor, a drive mechanism of the garage door opener, a trolley of the garage door opener, an arm of the garage door opener, the garage door 104, one or more rollers of a track and roller system, one or more tracks of the track and roller system, one or more springs of a counterbalance system, one or more cables of the counterbalance system, the like, or any combination thereof that causes an alteration in the physical characteristic measured by the sensor 118 when the garage door 104 moves from the shut state to the open state. In this manner, the updated profile can be used to prevent at least some false alarms.

In an aspect, the duration of time during which the profile is produced can be completed at a specific time after the duration of time has commenced. The specific time can be a week, a month, or the like. The specific time can be determined automatically or the specific time can be selected by the user of the premises security system 100. Alternatively, the duration of time can be endless. For example, with each occurrence of the garage door 104 being moved from the shut state to the open state, a recording of the rate of change of the physical characteristic measured by the sensor 118 can be made. This recording can be analyzed with respect to the profile. If information about an aspect of a current occurrence is within a threshold of statistical information about a corresponding aspect included in the profile, then the profile can be updated to include the information about the current occurrence. In an aspect, the profile can be updated in a manner in which, in response to including the information about the current occurrence in the profile, information about an earlier occurrence can be removed from the profile.

For example, if the rate of movement of the first axis component for a current occurrence is within the standard deviation of the rate of movement of the first axis component included in the profile, then the profile can be updated to include the information about the current occurrence. In this manner, for example, the profile can be updated gradually to account for changes due to aging of the motor, the shaft, the drive mechanism, the trolley, the arm, the garage door 104, the one or more rollers, the one or more tracks, the one or more springs, the one or more cables, the like, or any combination thereof that causes a gradual alteration in the transition of the forces sensed by one or more axes of the accelerometer 202 when the garage door 104 changes from the shut state to the open state. For example, the forces produced by the springs of the counterbalance system can become smaller in response to aging of the springs. Because a portion of these forces can be sensed by the one or more axes of the accelerometer 202, this portion of these forces can also become smaller in response to the aging of the springs. In this manner, the profile can be updated to prevent at least some false alarms.

In an aspect, the profile can further include information about dates and times associated with the occurrences of the garage door 104 being moved from the shut state to the open state that are included in the profile. A pattern can be derived from this information. For example, the pattern can indicate that during the weekdays, the garage door 104 is usually opened and shut between 8:00 am and 8:15 am, and is usually opened and shut between 5:45 pm and 6:00 pm. For example, the pattern can indicate that during the winter the garage door 104 is usually shut around 5:30 pm on the weekends, and that during the summer the garage door 104 is usually shut around 8:30 pm on the weekends.

The first port 404 can be configured to receive, from the sensor 118, a first signal that corresponds to the current movement of the point 102 on the garage door 104. If the sensor 118 includes the accelerometer 202, then the first signal can correspond to the change in the gravitational force sensed by the first axis component of the accelerometer 202. The first axis component can be along the height (h) of the garage door 104. In an aspect, the first signal can further correspond to the change in the gravitational force sensed by the second axis component of the accelerometer 202 and the change in the gravitational force sensed by the third axis component of the accelerometer 202. The second axis component can be along the thickness (t) of the garage door 104. The third axis component can be along the length (l) of the garage door 104. In an aspect, the first signal can further correspond to one or more other forces sensed by the accelerometer 202. For example, the one or more other forces can be produced by a rotation of a shaft of a motor of the garage door opener, a rotation of a drive mechanism of the garage door opener, a vibration of a trolley of the garage door opener, a vibration of an arm of the garage door opener, a vibration of the garage door 104, a vibration of one or more rollers of a track and roller system, a vibration of one or more tracks of the track and roller system, a movement of one or more springs of a counterbalance system, a movement of one or more cables of the counterbalance system, the like, or any combination thereof. In an aspect, the one or more other forces can further be produced by a manufacturing defect in the motor, the shaft, the drive mechanism, the trolley, the arm, the garage door 104, the one or more rollers, the one or more tracks, the one or more springs, the one or more cables, the like, or any combination thereof. In an aspect, the one or more other forces can further be produced by post-installation damage to the motor, the shaft, the drive mechanism, the trolley, the arm, the garage door 104, the one or more rollers, the one or more tracks, the one or more springs, the one or more cables, the like, or any combination thereof.

The first processor 406 can be configured to perform an analysis of the first signal with respect to the profile. If the profile includes the statistical information about the one or more rates of the one or more previous movements of the point 102 on the garage door 104, then the analysis can be performed with respect to the statistical information. For example, if the sensor 118 includes the accelerometer 202, then the analysis can be performed with respect to the statistical information that can include a degree of constancy of a rate of movement of the first axis component, a degree of constancy of a rate of movement of the second axis component, a minimum rate of movement of the first axis component, a minimum rate of movement of the second axis component, a maximum rate of movement of the first axis component, a maximum rate of movement of the second axis component, a degree of consistency of a difference between forces sensed by the first axis component and forces sensed by the second axis component, a maximum rate of movement of the third axis component, an average of any of the foregoing, a median of the any of the foregoing, a standard deviation of the any of the foregoing, a histogram of the any of the foregoing, or any combination thereof.

For example, the degree of constancy of the rate of movement of the first axis component (along the height (h) of the garage door 104) when the garage door 104 is moved, by the garage door opener, from the shut state to the open state can be greater than the degree of constancy of the rate of movement of the first axis component when the garage door 104 is moved manually from the shut state to the open state. Likewise, the degree of constancy of the rate of movement of the second axis component (along thickness (t) of the garage door 104) when the garage door 104 is moved, by the garage door opener, from the shut state to the open state can be greater than the degree of constancy of the rate of movement of the second axis component when the garage door 104 is moved manually from the shut state to the open state.

In another example, having the rate of movement of the first axis component be less than the minimum rate of movement of the first axis component included in the statistical information, having the rate of movement of the second axis component be less than the minimum rate of movement of the second axis component included in the statistical information, or both can be an indication that the garage door 104 is being moved manually or abnormally. Likewise, having the rate of movement of the first axis component be greater than the maximum rate of movement of the first axis component included in the statistical information, having the rate of movement of the second axis component be greater than the maximum rate of movement of the second axis component included in the statistical information, or both can be an indication that the garage door 104 is being moved manually or abnormally.

In another example, the degree of consistency of the difference between forces sensed by the first axis component and forces sensed by the second axis component can be greater when the garage door 104 is being moved within the constraints of the track and roller system than the degree of consistency of the difference between forces sensed by the first axis component and forces sensed by the second axis component when the garage door 104 is being moved outside of the constraints of the track and roller system. Likewise, having the rate of movement of the third axis component (along the length (l) of the garage door 104) be greater than the maximum rate of movement of the third axis component included in the statistical information can be an indication that the garage door 104 is being moved outside of the constraints of the track and roller system. Having the garage door 104 being moved outside of the constraints of the track and roller system can be an indication that the garage door 104 is being moved by a potential intruder.

The first processor 406 can be configured to produce a result of the analysis. If the profile includes the statistical information about the one or more rates of the one or more previous movements of the point 102 on the garage door 104, then the result can be produced with respect to the statistical information. In an aspect, the first processor 406 can be configured to determine a first difference between a first statistic of a rate of the current movement of the point 102 on the garage door 104 and the first statistic of the one or more rates of the one or more previous movements of the point 102 on the garage door 104. For example, the first difference can be between a measure of a degree of constancy of a rate of movement of the first axis component of the accelerometer 202 during the current movement of the point 102 on the garage door 104 and a measure of a degree of constancy of a rate of movement of the first axis component of the accelerometer 202 during the one or more previous movements of the point 102 on the garage door 104. The result can include the first difference.

In an aspect, the first processor 406 can be configured to determine a second difference between a second statistic of the rate of the current movement of the point 102 on the garage door 104 and the second statistic of the one or more rates of the one or more previous movements of the point 102 on the garage door 104. For example, the second difference can be between a measure of a minimum rate of movement of the second axis component of the accelerometer 202 during the current movement of the position of the point 102 on the garage door 104 and a measure of a minimum rate of movement of the second axis component of the accelerometer 202 during the one or more previous movements of the position of the point 102 on the garage door 104. The first processor 406 can be configured to determine a sum of the first difference added to the second difference. The result can include the sum.

In an aspect, the first processor 406 can be configured to determine a first product of the first difference multiplied by a first weight, to determine a second product of the second difference multiplied by a second weight, and to determine a sum of the first product added to the second product. A weight can be any real number. The real number can be a rational number or an irrational number, a positive number or a negative number, a whole number or a fraction, or any combination thereof. For example, the first weight and the second weight can be selected so that an effect of the first difference on the result can be greater than an effect of the second difference on the result.

Additionally, the first processor 406 can be configured to determine a mathematical equation that includes one or more other differences, one or more other weights, or both. In general, if the result is based on a difference between a statistic of the rate of the current movement of the point 102 on the garage door 104 and the statistic of the one or more rates of the one or more previous movements of the point 102 on the garage door 104, then a large value of the result can be indicative of a large difference, which can be indicative that the movement of the garage door 104 is abnormal.

Optionally, the system 400 can include a second processor 408 and a second port 410. This situation is illustrated in FIG. 4 by the use of dotted lines for an embodiment of the system 400 that includes the second processor 408 and the second port 410. For example, the second processor 408 can be the one or more controller devices 120 illustrated in FIG. 1. In an aspect, the second processor 408 can be the first processor 406. For example, the first processor 406 and the second processor 408 can be the one or more controller devices 124 illustrated in FIG. 1.

The second processor 408 can be configured to determine, based on the result of the analysis, the response to the current movement of the point 102 on the garage door 104. For example, the response can include an activation of an alarm, an activation of a lock, a transmission of a message to a communications device of the user of the premises security system 100, a transmission of a message to a communications device of a security agency, the like, or any combination thereof. The alarm can be an audible alarm, a visual alarm, a tactile alarm, or any combination thereof. The message can be transmitted via a circuit-switched network, a packet-switched network, or both. The communications device can be a telephone, a smartphone, a cellular phone, a personal digital assistant, a wireless communication device, a handheld device, a desktop computer, a laptop computer, a netbook, a tablet computer, or the like. The security agency can be a private security agency, a police force, or both.

In an aspect, the response can include more than one response. If the result is based on a difference between a statistic of the rate of the current movement of the point 102 on the garage door 104 and the statistic of the one or more rates of the one or more previous movements of the point 102 on the garage door 104, then a large value of the result can be indicative of a large difference, which can be indicative that the movement of the garage door 104 is abnormal. The more than one response can be a function of a difference between the result (the result itself can be based on a difference) and a threshold. For example, the second processor 408 can be configured to select a first response if the difference between the result and the threshold is a negative number (i.e., the result is within the threshold). For example, the first response can be the transmission of the message to the communications device of the user of the premises security system 100. The second processor 408 can be configured to select a second response if the difference between the result and the threshold is a positive number (i.e., the result is beyond the threshold). For example, the second response can be the activation of the alarm, the activation of the lock, the transmission of the message to the communications device of the user of the premises security system 100, the transmission of the message to the communications device of the security agency, the like, or any combination thereof. Additionally, the more than one response can include more than two responses, the threshold can include more than one threshold, or both. In this manner, the threshold can be used to prevent at least some false alarms.

The second port 410 can be configured to transmit a second signal based on the response. For example, the second signal can be configured to cause the activation of the alarm, the activation of the lock, the transmission of the message to the communications device of the user of the premises security system 100, the transmission of the message to the communications device of the security agency, the like, or any combination thereof. In an aspect, the second processor 408 can be configured to delay, based on the result being within a threshold, a transmission of the second signal for a duration of time. For example, if a recent incident caused a dent to be produced at a point in one of the tracks of the track and roller system, then forces associated with such an alteration can be sensed by the one or more axes of the accelerometer 202 when the user of the premises security system 100 uses the garage door opener to open the garage door 104. If the result of the analysis is based on a difference between a statistic of the rate of the current movement of the point 102 on the garage door 104 and the statistic of the one or more rates of the one or more previous movements of the point 102 on the garage door 104, then such an alteration can produce an abnormal result. The response based on the abnormal result can be a transmission of a message to a communications device of the user of the premises security system 100 and an activation of an alarm. However, if the abnormal response is within the threshold, then the transmission of the second signal to cause the activation of the alarm can be delayed for a duration of time. For example, the duration of time can be an amount of time to allow the user of the premises security system 100 to respond to the message received at the communications device by causing the premises security system 100 to prevent the activation of the alarm. For example, the duration of time can be about three minutes. In this manner, the delay for the duration of time can be used to prevent at least some false alarms.

Figure 5:
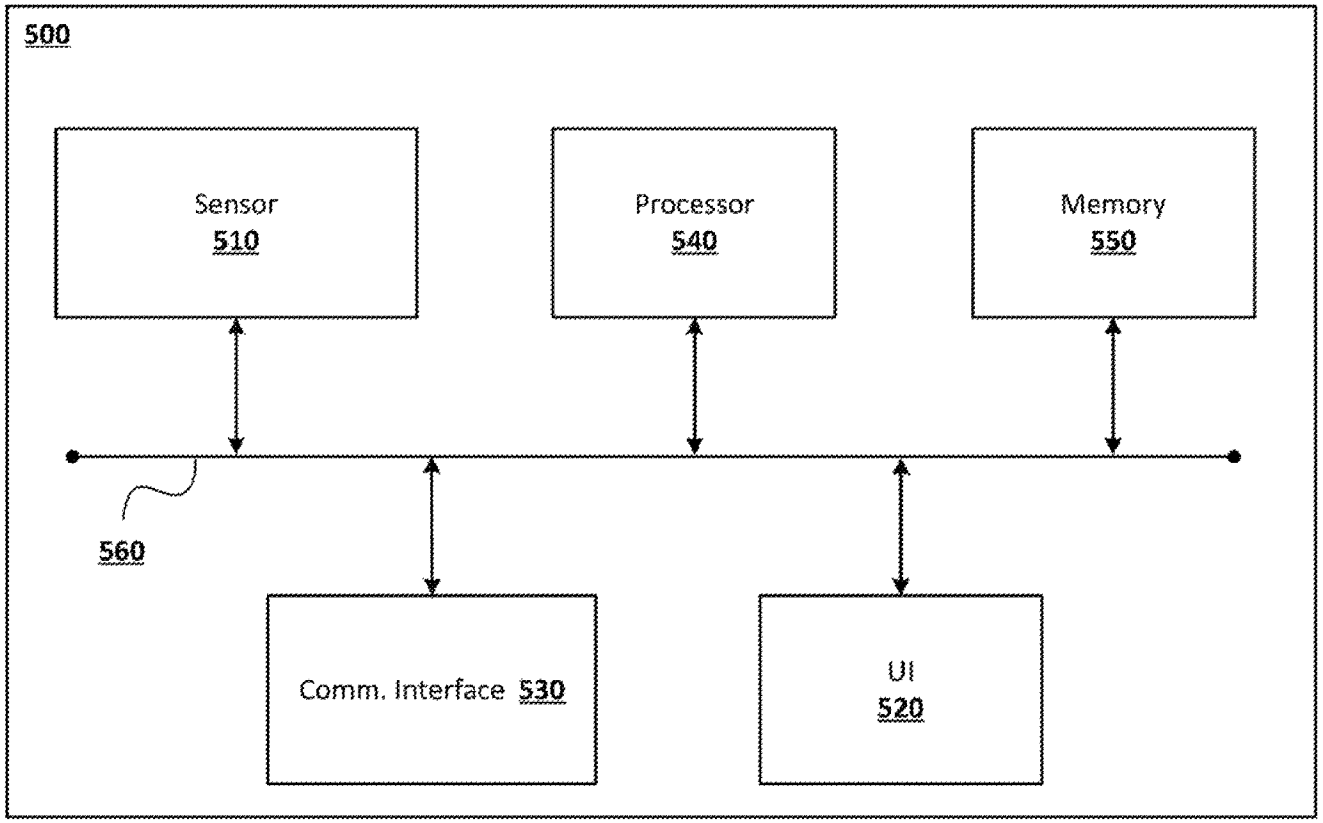
FIG. 5 is a block diagram illustrating an example of an embodiment of a premises management device.

FIG. 5 is a block diagram illustrating an example of an embodiment of a premises management device 500. Premise management device 500 can include a processor 540, a memory 550, a user interface (UI) 520, a communications interface 530, an internal bus 560, and a sensor 510. A person of ordinary skill in the art appreciates that various components of the premises management device 500 described herein can include additional electrical circuit(s). Furthermore, it is appreciated that many of the various components listed above can be implemented on one or more integrated circuit (IC) chips. For example, in one embodiment, a set of components can be implemented in a single IC chip. In other embodiments, one or more of respective components can be fabricated or implemented on separate IC chips.

The sensor 510 can be an environmental sensor, such as a temperature sensor, smoke sensor, carbon monoxide sensor, motion sensor, accelerometer, proximity sensor, passive infrared (PIR) sensor, magnetic field sensor, radio frequency (RF) sensor, light sensor, humidity sensor, pressure sensor, microphone, compass, or any other environmental sensor that obtains or provides a corresponding type of information about the environment in which the premises management device 500 is located.

The processor 540 can be a central processing unit (CPU) or other type of processor and can be communicably connected to the other components to receive and analyze data obtained by the sensor 510, can transmit messages or packets that control operation of other components of the premises management device 500 and/or external devices, and can process communications between the premises management device 500 and other devices. The processor 540 can execute instructions and/or computer executable components stored on the memory 550. Such computer executable components can include, for example, a primary function component to control a primary function of the premises management device 500 related to managing a premises, a communication component to locate and communicate with other compatible premises management devices, a computational component to process system related tasks, or any combination thereof.

The memory 550 or another memory in the premises management device 500 can also be communicably connected to receive and store environmental data obtained by the sensor 510. A communication interface 530 can function to transmit and receive data using a wireless protocol, such as a WiFi™, Thread®, or other wireless interface, Ethernet® or other local network interface, Bluetooth® or other radio interface, or the like and can facilitate transmission and receipt of data by the premises management device 500 to and from other devices.

The user interface (UI) 520 can provide information and/or receive input from a user of system 100. The UI 520 can include, for example, a speaker to output an audible sound when an event is detected by the premises management device 500. Alternatively, or in addition, the UI 520 can include a light to be activated when an event is detected by the premises management device 500. The UI 520 can be relatively minimal, such as a liquid crystal display (LCD), light-emitting diode (LED) display, or limited-output display, or it can be a full-featured interface such as a touch-screen, keypad, or selection wheel with a click-button mechanism to enter input.

Internal components of the premises management device 500 can transmit and receive data to and from one another via an internal bus 560 or other mechanism. One or more components can be implemented in a single physical arrangement, such as where multiple components are implemented on a single integrated circuit. Premises management devices 500 can include other components, and/or may not include all of the components illustrated.

The sensor 510 can obtain data about the premises, and at least some of the data can be used to implement the security system. Through the bus 560 and/or communication interface 530, sensor data can be transmitted to or accessible by other components of the system 100. Generally, two or more sensors 510 on one or more premises management devices 500 can generate data that can be coordinated by the primary system processor to determine a system response and/or infer a state of the environment. In one example, the primary system processor of the system 100 can infer a state of intrusion based on data from entry detection sensors and motion sensors and, based on the determined state, further determine whether an unauthorized party is present and a location, within the premises, of the unauthorized party.

Figure 6:
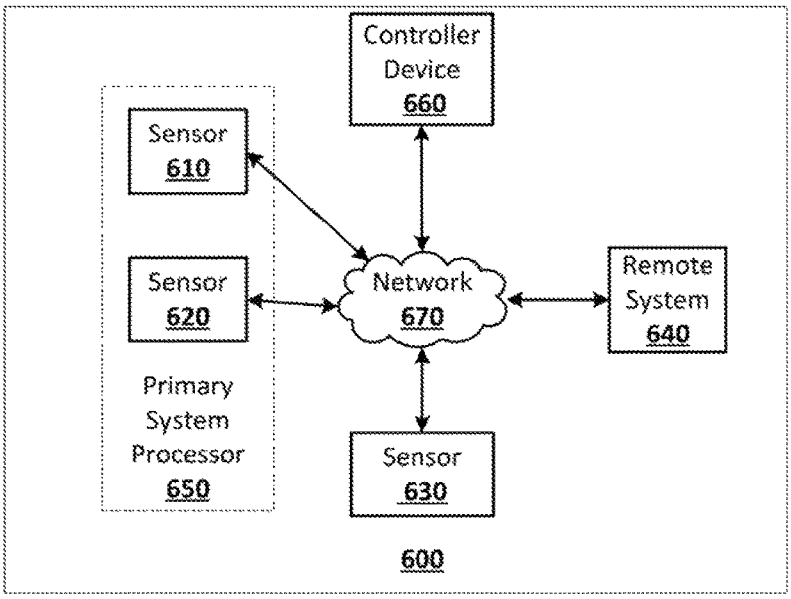
FIG. 6 is a block diagram illustrating an example of an embodiment of a premises management system.

FIG. 6 is a block diagram illustrating an example of an embodiment of a premises management system 600. The premises management system 600 can include security system features. System 600 can be implemented over any suitable wired and/or wireless communication networks. One or more premises management devices, i.e., sensors 610, 620, 630, and one or more controller devices 124 can communicate via a local network 670, such as a WiFi™ or other suitable network, with each other. The network 670 can include a mesh-type network such as Thread®, which can provide network architecture and/or protocols for devices to communicate with one another. An authorized party can therefore interact with the premises management system 600, for example, using the controller device 124, which can communicate with the rest of the system 600 via the network 670.

The controller device 124 and/or one or more of the sensors 610, 620, 630, can be configured to implement a primary system processor 650. The primary system processor 650 can, for example, receive, aggregate, and/or analyze environmental information received from the sensors 610, 620, 630, and the controller device 124. Furthermore, a portion or percentage of the primary system processor 650 can be implemented in a remote system 640, such as a cloud-based reporting and/or analysis system. The remote system 640 can, for example, independently aggregate data from multiple locations, provide instruction, software updates, and/or aggregated data to a controller 124, primary system processor 650, and/or sensors 610, 620, 630.

The sensors 610, 620, 630, can be disposed locally to one another, such as within a single dwelling, office space, building, room, or the like, or they may be disposed remote from each other, such as at various locations around a wide perimeter of a premises. In some embodiments, sensors 610, 620, 630, can communicate directly with one or more remote systems 640. The remote system 640 can, for example, aggregate data from multiple locations, provide instruction, software updates, and/or aggregated data to the primary system processor 650, controller device 124, and/or sensors 610, 620, 630. In addition, remote system 640 can refer to a system or subsystem that is a part of a third party monitoring service or a law enforcement service.

The premises management system illustrated in FIG. 6 can be a part of a smart-home environment, which can include a structure, such as a house, office building, garage, mobile home, or the like. The devices of the smart home environment, such as the sensors 610, 620, 630, and the network 670 can be integrated into a smart-home environment that does not include an entire structure, such as a single unit in an apartment building, condominium building, or office building.

The smart home environment can control and/or be coupled to devices outside of the structure. For example, one or more of the sensors 610, 620 can be located outside the structure at one or more distances from the structure (e.g., sensors 610, 620 can be disposed outside the structure, at points along a land perimeter on which the structure is located, or the like. One or more of the devices in the smart home environment may need not be physically within the structure. For example, the controller 124, which can receive input from the sensors 610, 620, can be located outside of the structure.

The structure of the smart-home environment can include a plurality of rooms, separated at least partly from each other via walls. The walls can include interior walls or exterior walls. Each room can further include a floor and a ceiling. Devices of the smart-home environment, such as the sensors 610, 620, can be mounted on, integrated with, and/or supported by a wall, floor, or ceiling of the structure.

The controller device 124 can be a general or special-purpose controller. For example, one type of controller device 124 can be a general-purpose computing device running one or more applications that collect and analyze data from one or more sensors 610, 620, 630 within the home. In this case, the controller device 1560 can be implemented using, for example, a mobile computing device such as a mobile phone, a tablet computer, a laptop computer, a personal data assistant, or wearable technology. Another example of a controller device 124 can be a special-purpose controller that is dedicated to a subset of functions, such as a security controller that collects, analyzes and provides access to sensor data primarily or exclusively as it relates to various security considerations for a premises. The controller device 124 can be located locally with respect to the sensors 610, 620, 630 with which it can communicate and from which it can obtain sensor data, such as in the case where it is positioned within a home that includes a home automation and/or sensor network. Alternatively or in addition, controller device 124 can be remote from the sensors 610, 620, 630, such as where the controller device 124 is implemented as a cloud-based system that can communicate with multiple sensors 610, 620, 630, which can be located at multiple locations and can be local or remote with respect to one another.

Sensors 610, 620, 630 can communicate with each other, the controller device 124, and the primary system processor 650 within a private, secure, local communication network that can be implemented wired or wirelessly, and/or a sensor-specific network through which sensors 610, 620, 630 can communicate with one another and/or with dedicated other devices. Alternatively, as illustrated in FIG. 6, one or more sensors 610, 620, 630 can communicate via a common local network 670, such as a Wi-Fi™, Thread®, or other suitable network, with each other, and/or with the controller 124 and primary system processor 650. Alternatively or in addition, sensors 610, 620, 630 can communicate directly with a remote system 640.

The smart-home environment, including the sensor network shown in FIG. 6, can include a plurality of premises management devices, including intelligent, multi-sensing, network-connected devices that can integrate seamlessly with each other and/or with a central server or a cloud-computing system (e.g., controller 124 and/or remote system 640) to provide home-security and smart-home features. Such devices can include one or more intelligent, multi-sensing, network-connected thermostats (e.g., "smart thermostats"), one or more intelligent, network-connected, multi-sensing hazard detection units (e.g., "smart hazard detectors"), one or more intelligent, multi-sensing, network-connected entryway interface devices (e.g., "smart doorbells"), or any combination thereof. The smart hazard detectors, smart thermostats, and smart doorbells can be, for example, the sensors 610, 620, 630 illustrated in FIG. 6. These premises management devices can be used by the security system, but can also have separate, primary functions.

For example, a smart thermostat can detect ambient climate characteristics (e.g., temperature and/or humidity) and can accordingly control a heating, ventilating, and air conditioning (HVAC) system of the structure. For example, the ambient climate characteristics can be detected by sensors 610, 620, 630 illustrated in FIG. 6, and the controller 660 can control the HVAC system (not illustrated) of the structure. However, unusual changes in temperature of a given room can also provide data that can supplement a determination of whether a situation is a security concern, for example, detecting a rapid drop in temperature in a given room due to a broken in window.

As another example, a smart hazard detector can detect the presence of a hazardous substance or a substance indicative of a hazardous substance (e.g., smoke, fire, or carbon monoxide). For example, smoke, fire, and/or carbon monoxide can be detected by sensors 610, 620, 630 illustrated in FIG. 6, and the controller 124 can control an alarm system to provide a visual and/or audible alarm to the user of the smart-home environment. However, the speaker of the hazard detector can also be used to announce security related messages.

As another example, a smart doorbell can control doorbell functionality, detect a person's approach to or departure from a location (e.g., an outer door to the structure), and announce a person's approach or departure from the structure via an audible and/or visual message that can be output by a speaker and/or a display coupled to, for example, the controller 124. However, the detection of an approach of an unknown party can provide data to the security system to supplement determining whether the presence of the unknown party is a security concern.

A smart-home environment can include one or more intelligent, multi-sensing, network-connected entry detectors (e.g., "smart entry detectors") that can be specifically designed to function as part of a security subsystem. Such detectors can be or can include one or more of the sensors 610, 620, 630 illustrated in FIG. 6. The smart entry detectors can be disposed at one or more windows, doors, and other entry points of the smart-home environment to detect when a window, door, or other entry point is opened, broken, breached, and/or compromised. The smart entry detectors can generate a corresponding signal to be provided to the controller 124, primary system processor 650, and/or the remote system 640 when a window or door is opened, closed, breached, and/or compromised. In some embodiments of the security system, the alarm, which can be included with controller 124 and/or coupled to the network 670, may not arm unless all smart entry detectors (e.g., sensors 610, 620, 630) indicate that all doors, windows, entryways, and the like are closed and/or that all smart entry detectors are armed.

The smart thermostats, the smart hazard detectors, the smart doorbells, the smart entry detectors, and other premise management devices of a smart-home environment (e.g., as illustrated as sensors 610, 620, 630 of FIG. 6) can be communicatively connected to each other via the network 670, and to the controller 124, primary system processor 650, and/or remote system 640.

One or more users can control one or more of the network-connected smart devices in the smart-home environment using a network-connected computer or portable electronic device. In some examples, some or all of the users (e.g., individuals who live in the home) can register their mobile device, token and/or key fobs with the smart-home environment (e.g., with the controller 124). Such registration can be made at a central server (e.g., the controller 124 and/or the remote system 640) to authenticate the user and/or the electronic device as being associated with the smart-home environment, and to provide permission to the user to use the electronic device to control the network-connected smart devices and the security system of the smart-home environment. A user can use their registered electronic device to remotely control the network-connected smart devices and security system of the smart-home environment, such as when the occupant is at work or on vacation. The user can also use their registered electronic device to control the network-connected smart devices when the user is located inside the smart-home environment.

Alternatively, or in addition to registering electronic devices, the smart-home environment can make inferences about which individuals live in the home and are therefore users and which electronic devices are associated with those individuals. As such, the smart-home environment can "learn" who is a user (e.g., an authorized user) and permit the electronic devices associated with those individuals to control the network-connected smart devices of the smart-home environment (e.g., devices communicatively coupled to the network 70) including, in some embodiments, sensors used by or within the smart-home environment. Various types of notices and other information can be provided to users via messages sent to one or more user electronic devices. For example, the messages can be sent via e-mail, short message service (SMS), multimedia messaging service (MMS), unstructured supplementary service data (USSD), as well as any other type of messaging services and/or communication protocols.

Figure 7:
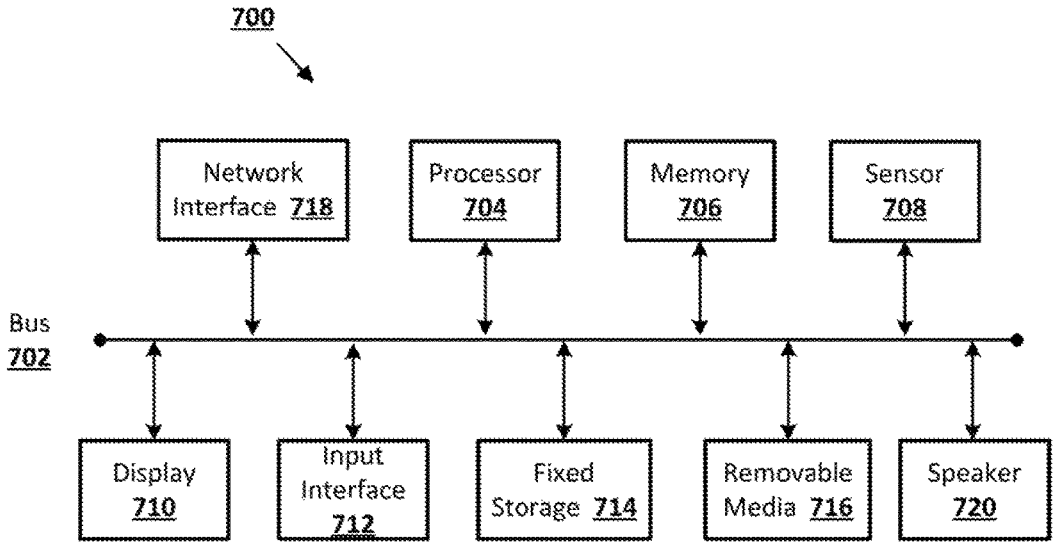
FIG. 7 is a block diagram illustrating an example of an embodiment of a computing device suitable for implementing certain devices illustrated in FIGS. 1 and 4 through 6.

FIG. 7 is a block diagram illustrating an example of an embodiment of a computing device 700 suitable for implementing certain devices illustrated in FIGS. 1 and 4 through 6. The computing device 700 can be used to implement, for example, the controller device 124 or a premises management device including sensors as described above. The computing device 700 can be constructed as a custom-designed device or can be, for example, a special-purpose desktop computer, laptop computer, or mobile computing device such as a smart phone, tablet, personal data assistant, wearable technology, or the like.

The computing device 700 can include a bus 702 that interconnects major components of the computing device 700. Such components can include a central processor 704; a memory 706 (such as Random Access Memory (RAM), Read-Only Memory (ROM), flash RAM, or the like), a sensor 708 (which can include one or more sensors), a display 710 (such as a display screen), an input interface 712 (which can include one or more input devices such as a keyboard, mouse, keypad, touch pad, turn-wheel, and the like), a fixed storage 714 (such as a hard drive, flash storage, and the like), a removable media component 716 (operable to control and receive a solid-state memory device, an optical disk, a flash drive, and the like), a network interface 718 (operable to communicate with one or more remote devices via a suitable network connection), and a speaker 720 (to output an audible communication). In some embodiments the input interface 712 and the display 710 can be combined, such as in the form of a touch screen.

The bus 702 can allow data communication between the central processor 704 and one or more memory components 714, 716, which can include RAM, ROM, or other memory. Applications resident with the computing device 700 generally can be stored on and accessed via a computer readable storage medium.

The fixed storage 714 can be integral with the computing device 700 or can be separate and accessed through other interfaces. The network interface 718 can provide a direct connection to the premises management system and/or a remote server via a wired or wireless connection. The network interface 718 can provide such connection using any suitable technique and protocol, including digital cellular telephone, WiFi™, Thread®, Bluetooth®, near field communications (NFC), and the like. For example, the network interface 718 can allow the computing device 700 to communicate with other components of the premises management system or other computers via one or more local, wide-area, or other communication networks.

The term substantially, as used herein, is understood by one of ordinary skill in the art to allow for a reasonable degree of deviation from a precise definition of another term. For example, substantially parallel or substantially in a plane can be understood to encompass a description of a predominant, if not exact, spatial relationship between two elements. In another example, having an element be substantially at a point can be understood to include those degrees of deviation from precisely at the point in which the element can function for its intended purpose. Likewise, having a shape that substantially forms an arc can be understood to refer to a description of a shape that reasonably matches the shape of an arc.

The foregoing description, for purpose of explanation, has been described with reference to specific embodiments. However, the illustrative discussions above are not intended to be exhaustive or to limit embodiments of the disclosed subject matter to the precise forms disclosed. Many modifications and variations are possible in view of the above teachings. The embodiments were chosen and described in order to explain the principles of embodiments of the disclosed subject matter and their practical applications, to thereby enable others skilled in the art to utilize those embodiments as well as various embodiments with various modifications as may be suited to the particular use contemplated.

The invention claimed is:

1. A premises security system, comprising:

a subsystem for analyzing a current movement of a point on a garage door, the subsystem including:

a memory configured to store a current profile, the current profile produced from a statistical information about a later set of at least one previous movement of the point on the garage door;

a first port configured to receive, from a sensor, a first signal that corresponds to the current movement of the point on the garage door; and a processor configured to:

produce an original profile from a statistical information about an earlier set of the at least one previous movement of the point on the garage door;

produce the current profile in response to the statistical information about the later set being within a standard deviation of the statistical information about the earlier set;

perform an analysis of the first signal with respect to the current profile;

produce a result of the analysis;

determine, based on the result of the analysis, a response, of the premises security system, to the current movement of the point on the garage door; and configure, based on the result of the analysis, the premises security system to prevent producing a false alarm.

2. The premises security system of claim 1, wherein the subsystem further includes a second port configured to transmit a second signal based on the response.

3. The premises security system of claim 2, wherein the second signal is configured to cause an activation of an alarm, an activation of a lock, a transmission of a message to a communications device of a user of a premises security system, a transmission of a message to a communications device of a security agency, or any combination thereof.

4. The premises security system of claim 2, wherein the processor is configured to delay, based on the result of the analysis being within a threshold, a transmission of the second signal for a duration of time.

5. The premises security system of claim 1, wherein:

the processor comprises a first processor and a second processor;

the first processor is configured to produce the original profile, produce the current profile, perform the analysis, and produce the result; and the second processor is configured to determine the response.

6. The premises security system of claim 1, wherein the response comprises a first response and a second response, and the processor is configured to select the first response based on the result of the analysis being within a threshold and to select the second response based on the result of the analysis being beyond the threshold.

7. The premises security system of claim 1, wherein the sensor comprises a camera, an infrared sensor, a Hall effect sensor, at least one switch, at least one magnetic switch, at least one microswitch, at least one limit switch, at least one tilt switch, at least one microelectromechanical switch, a gyroscope, an accelerometer, or any combination thereof.

8. The premises security system of claim 1, wherein the at least one previous movement of the point on the garage door corresponds to a movement of the garage door from a fully shut state to a fully open state.

9. The premises security system of claim 1, wherein the first port is configured to receive, from the sensor, at least one previous signal that corresponds to the at least one previous movement of the point on the garage door and the statistical information about the later set is about at least one rate of the at least one previous movement of the point on the garage door.

10. The premises security system of claim 9, wherein the memory is configured to store at least one record of the at least one previous signal, the current profile comprising the at least one record.

11. The premises security system of claim 9, wherein the first port is configured to receive the at least one previous signal and the processor is configured to produce the original profile automatically for a duration of time in response to the sensor being initially operated as a component of the premises security system.

12. The premises security system of claim 9, wherein the sensor comprises an accelerometer and the at least one previous signal corresponds to a change in a gravitational force sensed by a first axis component of the accelerometer, the first axis component being along a height of the garage door.

13. The premises security system of claim 12, wherein the at least one previous signal further corresponds to at least one other force sensed by the accelerometer, the at least one other force produced by a rotation of a shaft of a motor of a garage door opener, a rotation of a drive mechanism of the garage door opener, a vibration of a trolley of the garage door opener, a vibration of an arm of the garage door opener, a vibration of the garage door, a vibration of at least one roller of a track and roller system, a vibration of at least one track of the track and roller system, a movement of at least one spring of a counterbalance system, a movement of at least one cable of the counterbalance system, or any combination thereof.

14. The premises security system of claim 13, wherein the at least one other force is further produced by a manufacturing defect in the motor, the shaft, the drive mechanism, the trolley, the arm, the garage door, the at least one roller, the at least one track, the at least one spring, the at least one cable, or any combination thereof.

15. The premises security system of claim 13, wherein the at least one other force is further produced by post-installation damage to the motor, the shaft, the drive mechanism, the trolley, the arm, the garage door, the at least one roller, the at least one track, the at least one spring, the at least one cable, or any combination thereof.

16. The premises security system of claim 12, wherein the at least one previous signal further corresponds to a change in a gravitational force sensed by a second axis component of the accelerometer and a change in a gravitational force sensed by a third axis component of the accelerometer, the second axis component being along a thickness of the garage door, the third axis component being along a length of the garage door.

17. The premises security system of claim 16, wherein the statistical information comprises a degree of constancy of a rate of movement of the first axis component, a degree of constancy of a rate of movement of the second axis component, a minimum rate of movement of the first axis component, a minimum rate of movement of the second axis component, a maximum rate of movement of the first axis component, a maximum rate of movement of the second axis component, a degree of consistency of a difference between forces sensed by the first axis component and forces sensed by the second axis component, a maximum rate of movement of the third axis component, an average of any of the foregoing, a median of the any of the foregoing, a standard deviation of the any of the foregoing, a histogram of the any of the foregoing, or any combination thereof.

18. The premises security system of claim 17, wherein the processor is configured to determine a first difference between a first statistic of a rate of the current movement of the point on the garage door and the first statistic of the at least one rate of the at least one previous movement of the point on the garage door, the result of the analysis comprising the first difference.

19. The premises security system of claim 18, wherein the processor is configured to determine a second difference between a second statistic of the rate of the current movement of the point on the garage door and the second statistic of the at least one rate of the at least one previous movement of the point on the garage door and to determine a sum of the first difference added to the second difference, the result of the analysis comprising the sum.

20. The premises security system of claim 18, wherein the processor is configured to determine a first product of the first difference multiplied by a first weight, to determine a second difference between a second statistic of the rate of the current movement of the point on the garage door and the second statistic of the at least one rate of the at least one previous movement of the point on the garage door, to determine a second product of the second difference multiplied by a second weight, and to determine a sum of the first product added to the second product, the result of the analysis comprising the sum.

21. A method for analyzing a current movement of a point on a garage door, the method comprising:

producing, by a processor of a premises security system, an original profile from a statistical information about an earlier set of at least one previous movement of the point on the garage door;

producing, by the processor, a current profile from a statistical information about a later set of the at least one previous movement of the point on the garage door in response to the statistical information about the later set being within a standard deviation of the statistical information about the earlier set;

receiving, by the processor and from a sensor, a signal that corresponds to the current movement of the point on the garage door;

performing, by the processor, an analysis of the signal with respect to the current profile;

producing, by the processor, a result of the analysis;

determining, by the processor and based on the result of the analysis, a response, of the premises security system, to the current movement of the point on the garage door; and configuring, by the processor and based on the result of the analysis, the premises security system to prevent producing a false alarm.

22. A non-transitory computer-readable medium storing computer code for controlling a processor of a premises security system to cause the processor to analyze a current movement of a point on a garage door, the computer code including instructions to cause the processor to:

produce an original profile from a statistical information about an earlier set of at least one previous movement of the point on the garage door;

produce a current profile from a statistical information about a later set of the at least one previous movement of the point on the garage door in response to the statistical information about the later set being within a standard deviation of the statistical information about the earlier set;

receive, from a sensor, a signal that corresponds to the current movement of the point on the garage door;

perform an analysis of the signal with respect to the current profile;

produce a result of the analysis;

determine, based on the result of the analysis, a response, of the premises security system, to the current movement of the point on the garage door; and configure, based on the result of the analysis, the premises security system to prevent producing a false alarm.

* * * * *